US006911590B2

(12) United States Patent
Childress

(10) Patent No.: US 6,911,590 B2
(45) Date of Patent: Jun. 28, 2005

(54) INTERCHANGEABLE GUITAR

(75) Inventor: Robert E. Childress, Forest Hill, MD (US)

(73) Assignee: Chameleon Guitars LLC, Forest Hill, MD (US)

( * ) Notice: Subject to any disclaimer, the term of this patent is extended or adjusted under 35 U.S.C. 154(b) by 84 days.

(21) Appl. No.: 10/353,691

(22) Filed: Jan. 29, 2003

(65) Prior Publication Data

US 2003/0164080 A1 Sep. 4, 2003

Related U.S. Application Data

(60) Provisional application No. 60/353,500, filed on Jan. 31, 2002.

(51) Int. Cl.[7] ..... G10D 3/00

(52) U.S. Cl. ..... 84/291; 84/293; 84/298; 84/299; 84/312 R

(58) Field of Search ..... 84/291, 293, 290, 84/298, 299, 267, 312 R

(56) References Cited

U.S. PATENT DOCUMENTS

| | | | | |
|---|---|---|---|---|
| 3,657,462 A | | 4/1972 | Robinson | |
| 3,962,948 A | * | 6/1976 | Marletta | 84/294 |
| 4,132,143 A | | 1/1979 | Stone | |
| 4,177,705 A | * | 12/1979 | Evangelista | 84/722 |
| 4,297,936 A | | 11/1981 | Mouton | |
| 4,377,962 A | | 3/1983 | Parker | |
| 4,408,515 A | | 10/1983 | Sciuto | |
| 4,428,892 A | * | 1/1984 | Berliner | 261/99 |
| 4,432,267 A | * | 2/1984 | Feller | 84/293 |
| 4,433,603 A | | 2/1984 | Siminoff | |
| 4,491,051 A | | 1/1985 | Barcus | |
| 4,649,793 A | * | 3/1987 | Blackshear et al. | 84/453 |
| 4,686,882 A | | 8/1987 | Shaw | |
| 4,712,463 A | * | 12/1987 | Kubicki et al. | 84/304 |
| 4,777,858 A | * | 10/1988 | Petschulat et al. | 84/314 R |
| 4,867,031 A | * | 9/1989 | Fender | 84/313 |
| 4,872,386 A | | 10/1989 | Betticare | |
| 4,915,003 A | | 4/1990 | Clough | |
| 4,915,004 A | | 4/1990 | Clough | |
| 5,058,479 A | | 10/1991 | Shaw | |
| 5,315,910 A | | 5/1994 | Soupios | |
| 5,347,904 A | | 9/1994 | Lawrence | |
| 5,353,672 A | | 10/1994 | Stewart | |
| 5,383,385 A | * | 1/1995 | Gilbert | 84/267 |
| 5,421,233 A | | 6/1995 | Bunker | |
| 5,442,986 A | | 8/1995 | Cota | |
| 5,631,432 A | | 5/1997 | Muncy | |
| 5,637,823 A | | 6/1997 | Dodge | |
| 5,929,362 A | | 7/1999 | Oteyza | |
| 5,945,614 A | * | 8/1999 | White | 84/267 |
| 5,952,593 A | | 9/1999 | Wilder | |
| 5,994,633 A | | 11/1999 | Norton | |

(Continued)

OTHER PUBLICATIONS

U.S. Appl. No. 60/353,500, filed Jan. 31, 2002

Article from the Internet entitled "Anatomy of the Acoustic Guitar", Jan. 2003.

Internet information from www.chameleon–guitars.com website, Jan. 2003.

Internet information from www.chrysalisguitars.com website, Nov. 2001.

*Primary Examiner*—Shih-Yung Hsieh

(74) *Attorney, Agent, or Firm*—Fay Sharpe Fagan Minnich & McKee; Brian E. Turung

(57) ABSTRACT

A guitar having a shell body and a main body. The main body and/or a portion of the main body is detachably connected to the shell body. A neck is connected to the main body and/or the shell body. A bridge is connected to the main body. The neck includes a headstock and a fret control that at least partially raises and/or lowers at least one fret on the neck.

57 Claims, 16 Drawing Sheets

U.S. PATENT DOCUMENTS 6,005,173 A 12/1999 Mitchell
6,028,255 A * 2/2000 Myronyk ..... 84/293
6,037,532 A 3/2000 Beckmeir
6,046,393 A 4/2000 Rose
6,111,184 A 8/2000 Cloud et al.
6,137,039 A 10/2000 Rose
6,156,961 A 12/2000 Beckmeier
6,188,005 B1 2/2001 White
6,194,644 B1 * 2/2001 Hendrickson ..... 84/291
6,198,030 B1 3/2001 Rose
6,209,717 B1 * 4/2001 Flynn ..... 206/204
6,262,353 B1 * 7/2001 Murray ..... 84/290
6,274,800 B1 8/2001 Gardner
6,300,550 B1 10/2001 Smith
6,376,756 B1 4/2002 Beckmeier
6,600,096 B2 * 7/2003 Jarvis ..... 84/453
2002/0152659 A1 10/2002 Hartill

* cited by examiner

FIG. 5
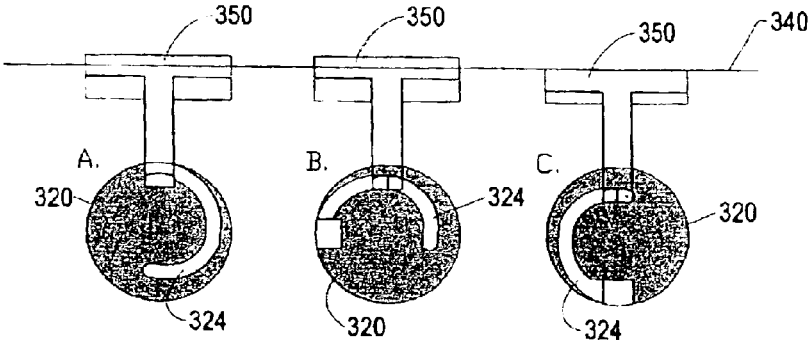
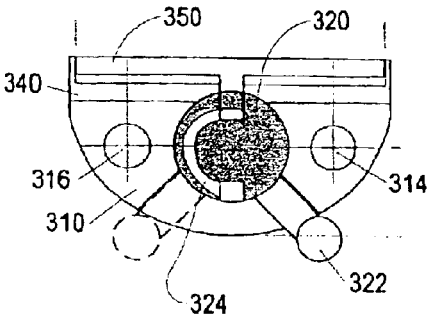
FIG. 6
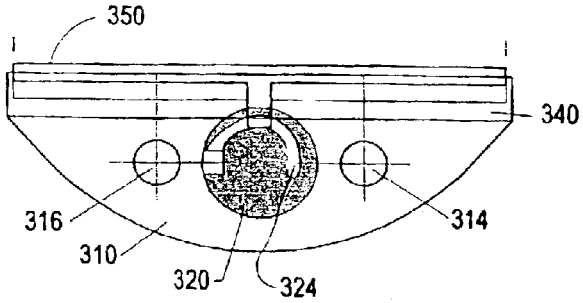
FIG. 7

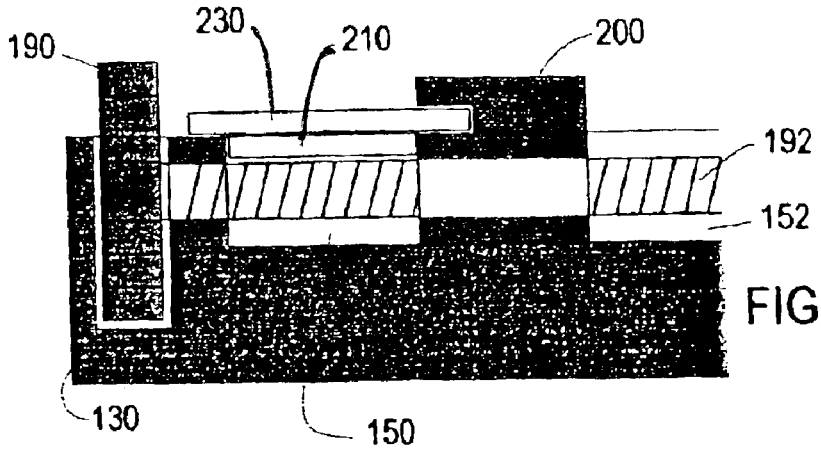
FIG. 8A
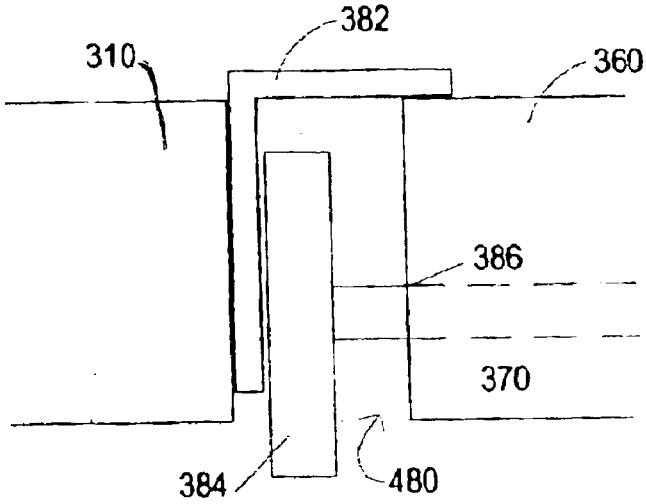
FIG. 9
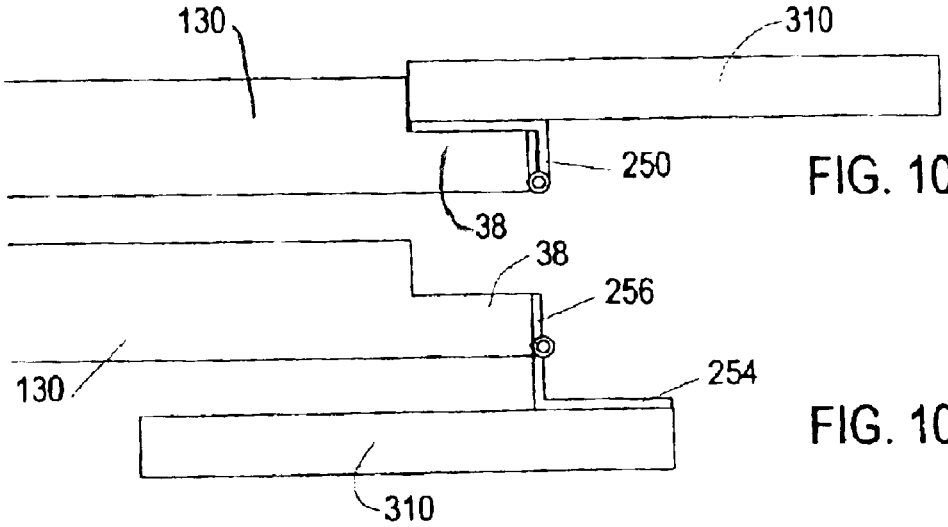
FIG. 10A
FIG. 10B

INTERCHANGEABLE GUITAR

The present invention claims priority of U.S. Provisional Application Ser. No. 60/353,500 filed Jan. 31, 2002.

The present invention relates to musical instruments, and more particularly to stringed instruments, and even more particularly to modular stringed instruments.

INCORPORATION BY REFERENCE

Incorporated herein by reference are U.S. Pat. Nos. 3,657,462; 4,132,143; 4,297,936; 4,377,962; 4,408,515; 4,433,603; 4,491,051; 4,686,882; 4,872,386; 4,915,003; 4,915,004; 5,058,479; 5,315,910; 5,347,904; 5,353,672; 5,383,385; 5,421,233; 5,631,432; 5,637,823; 5,929,362; 5,442,986; 5,945,614; 5,952,593; 5,994,633; 6,005,173; 6,028,255; 6,037,532; 6,046,393; 6,111,184; 6,137,039; 6,156,961; 6,188,005; 6,194,644; 6,198,030; 6,262,353; 6,274,800; 6,300,550 and 6,376,756; and U.S. Provisional Patent Application Ser. Nos. 60/353,500 filed Jan. 31, 2002 and 10/078,899 filed Feb. 19, 2002 (U.S. Pub. No. 20020152659); and the web pages of Chrysalis Guitar Company to illustrate various prior art guitars and/or guitar components. Many of the features disclosed in these publications can be used in the present invention.

BACKGROUND OF THE INVENTION

Various types of guitars are used by musicians when composing and/or performing songs. The guitar style used to compose and/or play a particular song can be dictated by the style of music and/or the chords needed to play the song. For instance, the shape and/or style of a guitar used to perform rock music is typically different from a guitar style used to perform country music, blues music, and the like. Typically each style of music requires the use of a commonly accepted guitar style and shape that the fans and musicians alike are accustomed to seeing and playing. In addition, some types of music require the guitar to have a certain number of strings (e.g. 4, 5, 6, 12, etc.) in order to properly perform the song. Furthermore, some songs require a fretless guitar to be played, thereby requiring a special guitar for this technique. The guitarist may want or need to play a guitar having a particular shape and/or graphic display during certain events. As a result, a guitarist typically must have several different guitars to perform a variety of songs for a particular style of music and/or at a particular event. If the guitarist performs more than one style of music, the guitarist must also have a complete set of guitars acceptable for playing these other styles of music. The expense associated with owning and/or obtaining these various types of guitars can become cost prohibitive for a guitarist. As such, many guitarists must select one or two guitars that can perform as many forms of music as possible. Furthermore, the storage requirements for multiple guitars, especially when traveling, can become very inconvenient and costly. The time necessary to pack, unpack, and transport all these types of guitars can also become very time consuming and inconvenient.

In view of the present state of art for guitars, there is a need for a guitar that can be used to compose and/or perform different styles of music. In addition, there is a need for a guitar that is more convenient to store and/or transport. Furthermore, there is a need for a guitar that can have a variety of designs.

SUMMARY OF THE INVENTION

The present invention is directed to stringed instruments, and more particularly to guitars, such as electric and acoustic guitars, and will be described with particular reference thereto; however, the invention has broader applications, and can be applied to many other types of stringed instruments. The guitar of the present invention is design to address many of the problems associated with guitar design, guitar storage, and/or guitar versatility.

The principal aspect of the present invention is related to a novel guitar that can be easily modified for a variety of applications without the need to maintain an inventory of multiple guitars of varying types. In essence, the guitar of the present invention enables a guitarist to easily modify a single guitar to emulate a variety of different guitars. In one embodiment of the invention, the shell body of the guitar is separable from the main body of the guitar so that various shell body configurations can be secured to a single main body. For an electric guitar, the main body generally includes pickups and a string bridge and/or string bridge connector. For an acoustic guitar, the main body generally includes a string bridge and/or string bridge connector. The neck of guitar can be connected to the shell body and/or the main body. The shell body is designed to at least partially receive the main body of the guitar and to be detachably connected to the main body. In one aspect of this embodiment, the shell body of the guitar is a one piece that includes a cavity that receives the main body. In another and/or alternative aspect of this embodiment, the shell body is formed of multiple pieces that connect to the main body. In one non-limiting design, the shell body includes two pieces that at least partially sandwich the main body. The sandwiching of the main body at least partially between two or more pieces of the shell body has some aesthetic advantages over a single piece shell body. The sandwiching of the main body can at least partially hide one or more connectors used to connect the main body to the shell body, and/or at least partially hide the cavity of the shell body that is designed to at least partially receive the main body. As such, the surface of the shell body can be smoother and/or can be made to be more aesthetically pleasing to the user. In both of these aspects set forth above, the shell bodies of the guitar can have variable external styles, shapes and/or sizes. As a result, only multiple shell bodies are needed to acquire an inventory of various guitar shapes and styles. Such styles can include, but are not limited to, rock guitars, country guitars, and standard style guitars. The shell body can also be designed to hold one or more main bodies. As can be appreciated, any style of guitar can be used with the main body so long as the shell body incorporates the proper size opening and connector for the main body. In addition, the shell body can be removed from the main body and the main body can be played as a guitar without a shell body. The modular guitar of the present invention significantly reduces the costs associated with having multiple guitar styles. One main body can be used with multiple shell bodies or without a shell body. The modular guitar of the present invention also allows individuals to make their own shell body designs, and/or allows famous musicians to promote one or more shell body designs. The modular guitar of the present invention also has significant advantages for left-handed guitarists. In the past, left-handed guitarists have had fewer guitar design selections. The modular guitar of the present invention enables a left-handed guitarist to need only one main body, and the main body can be fitted into all types of shell body designs. The modular guitar of the present invention has the added advantage of having only to tune one main body, instead of tuning each separate guitar prior to playing a new guitar. For instance, a guitarist, while playing at a concert, uses a standard guitar style during the concert. During the concert, the musician decides to play a rock song and wants to use a guitar having a different shape. In such a situation, the guitarist simply removes the main body from the standard style shell body and inserts the main body into a shell body having the desired shape, and can then immediately begin to play. Since the strings on the main body are already tuned, the strings do not have to be retuned when the main body is switched to another shell body design. This advantage reduces the amount of disruption that can occur when guitar styles need to be changed during a concert or at any other type of performance. Another advantage of this design is that the shell body can be easily replaced without having to replace the main body. During the use of the guitar, the shell body is typically the part of the guitar that gets the most scratches, nicks, and/or other types of damage. In the past, the whole guitar had to be disposed of when the shell body was overly damaged or disfigured. When using the modular guitar of the present invention, the main body can be retained while the damaged or disfigured shell body is discarded, and only a new shell body needs to be purchased. The cost savings associated with the modular guitar of the present invention to a guitarist can be substantial. Another advantage is that the amount of storage space for a single main body and multiple shell bodies will be less than the storage space for multiple guitars. In another and/or alternative embodiment of the invention, the main body is detachably connected to the shell body by a connection mechanism. Such connection mechanism can include, but is not limited to VELCRO, screws, bolts, latches, clamps, pins, locks, cables, and/or the like. In one aspect of this embodiment, the connector allows the guitarist to quickly disconnect the main body from one shell body and to connect the main body to another shell body without any tools, or with very few tools. In still another and/or alternative embodiment of the invention, the main body and/or shell body includes one or more electronic components. Such electronic components include, but are not limited to, volume controls, tone controls, special effect controls, output jacks, electrical connectors, pickups, etc. In one aspect of this embodiment, the main body includes a plurality of electronic components. In one non-limiting design, the main body includes at least one pickup, and at least one electrical connector. In another and/or alternative non-limiting design, the main body includes at least one volume control, at least one tone control, and/or at least one special effect control. As can be appreciated, the volume control, tone control and/or special effect control can be combined into a single control knob. As can also be appreciated, a single control knob can be used to control the volume and/or tone of one or more pickups. In one non-limiting example, one control knob is used to control the volume and/or tone of the bass pickup, another control knob is used to control the volume and/or tone of the midrange pickup, and another control knob is used to control the volume and/or tone of the treble pickup. In still another and/or alternative aspect of this embodiment, the shell body includes a plurality of electronic components. In one non-limiting design, the shell body includes at least one electrical connector and at least one output jack. In another and/or alternative non-limiting design, the shell body includes at least one volume control, at least one tone control, and/or at least one special effect control. As can be appreciated, the volume control, tone control and/or special effect control can be combined into a single control knob. As can also be appreciated, a single control knob can be used to control the volume and/or tone of one or more pickups. In one non-limiting example, one control knob is used to control the volume and/or tone of the bass pickup, another control knob is used to control the volume and/or tone of the midrange pickup, and another control knob is used to control the volume and/or tone of the treble pickup. In yet another and/or alternative embodiment of the invention, the shell body includes at least one storage area. The storage area can be used to store one or more graphic clips that are attachable to the guitar, picks, capos, etc. In one aspect of this embodiment, at least one storage area is positioned in the central cavity of the shell body, which central cavity at least partially receives the main body. In another and/or alternative aspect of this embodiment, at least one storage area includes a connection arrangement to at least partially secure one or more accessories in the storage area. In still another and/or alternative aspect of this embodiment, at least one storage area includes a door and/or cover used to at least partially secure one or more accessories in the storage area.

In another and/or alternative aspect of the present invention, the headstock and bridge of the guitar are designed to be removable with the strings from the neck and main body of the guitar. In one embodiment of the invention, the headstock of the guitar is designed to be removable from the end of the neck. Many different connection configurations can be used to detachably connect the headstock to the neck. In one aspect of this embodiment, one or more pins or truss rods are used to connect the headstock to the neck. The one or more pins or truss rods can extend from the end of the headstock and/or the neck. In one non-limiting design, at least one pin or truss rod extends from the end of the neck and a headstock that includes at least one opening to receives the pin or truss rod. In another and/or alternative non-limiting design, one or more pins or truss rods extend from the headstock and the neck has at least one opening to receive the pin or truss rod. As can further be appreciated, many other pin and/or truss rod configurations can be used, and/or configurations that include connectors other than or addition to pins and/or truss rods can be used. In another and/or alternative embodiment of the invention, the bridge can be releasably connected to the main body in a number of different manners. Typically, the bridge is designed to be first loosed or detached from the main body when removing the bridge, headstock and strings from the main body, and the last to be secured to the main body when securing the headstock, string and bridge to the main body however, this is not required. In one aspect of this embodiment, the headstock is at least partially connected to the neck and the bridge is positioned on the main body of the guitar so that the strings are loosely aligned on the neck of the guitar. Once the bridge is positioned on the main body, the bridge is secured in position which results in the tensioning of the strings between the bridge and the headstock. In another and/or alternative aspect of this embodiment, a clamp is used to at least partially move the bridge into a locked and secure position and/or into an unlocked position. When the clamp is moved to a release position, tension on the strings is reduced thereby enabling the bridge to be moved and/or removed from the main body. When the clamp is moved to a locked or secured position, tension on the strings is increased thereby locking bridge onto the main body. In still another and/or alternative aspect of this embodiment, the bridge is at least partially secured to the main body by a slider connector which slides over a portion of the bridge. Once the slider engages the bridge, a tension wheel or other device can be used to cause the slider to move which in turn causes the bridge to move to a tension and/or locked position on the main body, resulting in the strings becoming tensioned. The tension wheel or other device can include a lock or latch to secure the tension wheel or other device in place. A motor can be connected to the tension wheel or other device to facilitate in adjusting and/or maintaining the tension of the strings. The bridge can be later removed by rotating the tension wheel or using another type of device to cause the slider to move to a non-tension or unlocked position thereby enabling the bridge to move to a position where the strings have little or no tension, and thereafter enabling the bridge to be removed from the slider connector and the main body. As can be appreciated, many other connection configurations for connecting the bridge to the main body can be used. In the embodiments set forth above, the guitarist need not repeatedly retune the strings when removing the headstock, bridge and strings from one guitar and then inserting the same headstock, bridge and strings onto another guitar, or when replacing a new headstock, bridge and strings on the guitar. Once the strings are tuned, the headstock, bridge and strings can be removed and later reinserted on the guitar without need of retuning or substantially retuning. Once the headstock, bridge and strings are reinserted, the tension on the strings will be the same as prior to the removal of the headstock, bridge and strings, thus the strings will not have to be retuned or substantially retuned. As can be appreciated, the removable headstock, bridge and strings allows the same guitar to accommodate different designs of a headstock, a bridge and strings such as, but not limited to a headstock, a bridge and strings having 4, 5, 6, 12, etc. string configurations. As a result, a single guitar can be easily transformed into a different type of guitar by simply removing an existing headstock, bridge and strings and inserting a new headstock, bridge and strings on the guitar. The advantages of quick interchangeability, costs of multiple guitars, and storage space concerns as previously discussed are also realized in the modular guitar of the present invention.

In still another and/or alternative aspect of the present invention, the headstock of the guitar is designed to minimize inadvertent string tension changes when the headstock is removed or reconnected to the neck of the guitar. The headstock typically includes several pegs that are used to adjust the tension of each string. When the headstock is inserted, removed, laid on a surface, or stored, the pegs can be caused to be inadvertently moved, thereby resulting in the string becoming out of tune. Furthermore, the pegs can be damaged when laid on a surface. Several embodiments of the invention can be used to inhibit or prevent such problems. In one embodiment of the invention, the strings are connected to sliding pins that are locked into position by a nut, screw, or the like. The nut, screw, etc. can be located beneath of the pins or rearwardly of the pins or at some other location on the headstock. In this embodiment, there are no pegs extending from the side of the headstock which can be caused to turn when the headstock is inserted, removed, laid on a surface, and/or stored. As a result, once the strings are tuned, the position of the pins on the headstock can be locked into position, thereby resulting in the strings being in proper tension when the headstock is reinserted onto the neck and/or while the headstock is on the neck of the guitar. The headstock can include one or more pins on a particular sliding platform. Such a design allows for a multitude of string configurations, thereby adding more versatility to the guitar. In another and/or alternative embodiment of the invention, a more traditional looking headstock is used that has pins on the side of the headstock. In this design, one or more pins are removable to reduce damage to the pins and/or to reduce the incidence of the inadvertent movement of the pin adversely affecting the tuning of one or more strings. In still another and/or alternative embodiment of the invention, another more traditional looking headstock is used which has pins on the side of the headstock, in which one or more pins are locked in position after one or more strings have been properly tuned. In yet another and/or alternative embodiment of the invention, a headstock protector is used to at least partially cover the headstock when the guitar is not in use. The headstock protector is designed to inhibit or prevent the pins and/or tuners from being hit or bumped out of tune and/or to prevent damage to such pins and/or tuners. The headstock protector is typically made of a durable material that resists damage such as, but not limited to, plastic, fiberglass, composite material, metal, etc. In one aspect of this embodiment, the headstock protector is a two piece unit that sandwiches at least a portion of the headstock. As can be appreciated, many other configurations of the headstock protector can used. In another and/or alternative aspect of this embodiment, the headstock protector includes a soft and/or compressible material that engages the headstock so as to reduce or prevent damage to the headstock. In this design, the outer shell of the headstock protector is typically made of a more durable material; however, this is not required.

In yet another and/or alternative aspect of the present invention, a humidity tuner is positioned on the neck to uniformly adjust the tension on all the strings due to temperature and/or humidity changes. Typically, the humidity tuner is at least partially positioned between the neck and the headstock; however, the humidity tuner can be positioned in other locations on the neck. The tension of the strings can change in different environments. Temperature and/or humidity levels in a particular environment can cause such changes in string tension. The humidity tuner is designed to adjust the string tension to account for such temperature and/or humidity changes. The humidity tuner uniformly causes all the strings to be increased or reduced in tension to substantially the same degree so as to adjust changes in temperature and/or humidity. As can be appreciated, the humidity tuner can cause one or more strings to be increased or reduced in tension more than one or more other strings. In one embodiment of the invention, the humidity tuner includes one or more knobs or wheels to cause the headstock to move relative to the neck. In this embodiment, the humidity tuner is designed to move the headstock farther from or closer to the end of the neck as needed to adjust for such temperature and/or humidity changes. In one aspect of this embodiment, a guide arm can be used to limit the direction of movement of the headstock. As can be appreciated, many other arrangements can be used to move the headstock relative to the neck. In another and/or alternative aspect of this embodiment, the humidity tuner can be alternatively or additionally located at the bridge connection on the main body. In one aspect of this embodiment, a tension wheel or other device is used to adjust the position of the bridge on the main body to adjust the string tension due to changes in temperature and/or humidity. In another and/or alternative embodiment of the invention, the humidity tuner can include one or more locks and/or latches to secure the humidity in position. In another and/or alternative embodiment of the invention, the humidity tuner can include one or more motors to facilitate in the adjustment of the humidity tuner. In one aspect of this embodiment, the humidity tuner is manually and/or automatically adjustable.

In still yet another and/or alternative aspect of the present invention, the guitar includes a neck that can be repositioned relative to the shell body. In one embodiment of the invention, the neck is connected to the main body, which in turn is detachably connected to the shell body. As can be appreciated, many types of connection arrangements can be used. As such, when the main body is removed from the shell body, the neck is also removed from the shell body. In one aspect of this embodiment, the neck is rigidly connected to the main body. In another and/or alternative aspect of this embodiment, the neck is detachably connected to the main body. The detachability of the neck from the main body can result in additional compact packing of the modular guitar. Additionally and/or alternatively, the detachability of the neck from the main body allows for different sized, shaped and/or styled necks to be connected to the main body. For instance, it may be desirable to shorten the length of the neck when converting the guitar from an electric bass guitar configuration to a standard electric guitar configuration or vice versa. In still another and/or alternative aspect of this embodiment, the neck is hingably connected to the main body. As can be appreciated, many types of hinges can be used. In one non-limiting arrangement, the hinge is a disconnectable hinge to allow the neck to be separated from the main body if desired. In another and/or alternative non-limiting arrangement, a lock and/or latch mechanism is be used to secure the neck in the extended and/or folded position. As can be appreciated, many types of locks and/or latches can be used. The ability to fold back the neck results in a substantial reduction in the length of the guitar. This reduction in length allows for more compact storage of the guitar. When the guitar is unpacked, the neck is simply pivoted into its extended position. Once the neck is repositioned in the extended position, the headstock can be connected to the end of the neck as discussed above, and/or the bridge can be secured to the main body of the guitar as discussed above. In another and/or alternative embodiment of the invention, the neck is connected to the shell body. In one aspect of this embodiment, the neck is detachably connected to the shell body. The detachability of the neck from the shell body can result in additional compact packing of the modular guitar. Additionally and/or alternatively, the detachability of the neck from the shell body allows for different sized, shaped and/or styled necks to be connected to the shell body. For instance, it may be desirable to shorten the length of the neck when converting the guitar from a bass guitar configuration to an electric guitar configuration or vice versa. In another and/or alternative aspect of this embodiment, the neck is hingably connected to the shell body. As can be appreciated, many types of hinges can be used. In one non-limiting arrangement, the hinge is a disconnectable hinge to allow the neck to be separated from the shell body if desired. In another and/or alternative non-limiting arrangement, a lock and/or latch mechanism is used to secure the neck in the extended and/or folded position. As can be appreciated, many types of locks and/or latches can be used. In still another and/or alternative aspect of this embodiment, one end of the shell body includes a ledge wherein the neck rests when the neck is in the fully extended position. When the headstock is removed from the one end of the neck and/or the bridge is released from the main body, the neck can be pivoted about the hinge that is connected to the shell body and the neck. The ability to fold back the neck results in a substantial reduction in the length of the guitar. This reduction in length allows for more compact storage of the guitar. When the guitar is unpacked, the neck is simply pivoted into its extended position. Once the neck is repositioned in the extended position, the headstock can be connected to the end of the neck as discussed above, and/or the bridge can be secured to the main body of the guitar as discussed above.

In a further and/or alternative aspect of the present invention, the neck of the guitar is modified to allow a guitarist to play the guitar in a fretted or fretless configuration. In one embodiment of the invention, the neck includes a mechanism that can raise and/or lower the frets on the upper face of the neck. In one aspect of this embodiment, the neck includes a cam mechanism to raise and/or lower the frets. As can be appreciated, other mechanisms can be used to raise and/or lower the frets. In another and/or alternative embodiment of the invention, the neck includes one or more truss rods to provide some structural integrity to the neck. As can be appreciated additional and/or alternative structures can be used to provided some structural integrity to the neck. In one aspect of this embodiment, the neck includes a fret control bar. The bar can have a substantially circular cross-section shape; however, other cross-sectional shapes can be used. The substantially circular cross-sectional shape of the fret control bar allows the fret control bar to be at least partially rotated in the neck. In another and/or alternative aspect of this embodiment, the fret control bar and/or truss rods are typically embedded in the neck; however, other configurations can be used. In still another and/or alternative aspect of this embodiment, the fret control bar can extend substantially the full length of the neck; however, the fret control bar can be designed to be shorter. In yet another and/or alternative aspect of this embodiment, the fret control bar can cause all the frets on the neck to be raised and/or lowered; however, the fret control bar can be designed to raise and/or lower only a portion of the frets on the neck. In still yet another and/or alternative aspect of this embodiment, the fret control bar can cause all the frets on the neck to be raised and/or lowered the substantially same distance; however, the fret control bar can be designed to raise and/or lower one or more frets in different amounts than one or more other frets. In a further and/or alternative aspect of this embodiment, the fret can have a substantially T-shape cross-sectional shape; however, other shapes can be used. In still a further and/or alternative aspect of this embodiment, the bottom end of the fret has a rounded end to facilitate the contact movement of the fret control rod and the bottom of the fret; however, other shapes can be used. In yet a further and/or alternative aspect of this embodiment, the bottom of the fret can be reinforced to resist wear. Such reinforcement can include, but is not limited to, higher strength materials, metal or polymer bearings, and the like. In yet another and/or alternative embodiment of the invention, a fret control bar passes through or about the bottom of the fret. The fret control bar facilitates in the movement of the frets. The fret control bar can be made of the same or different material than the fret. In one aspect of this embodiment, the fret control bar can a cylindrical configuration; however, other configurations can be used. In another and/or alternative aspect of this embodiment, the fret control bar engages one or more fret to at least partially control the movement of one or more frets. In one non-limiting design, the fret control bar includes one or more slot that engage a portion of one or more frets to cause the frets to raise and/or lower when the fret control bar is moved. In still yet another and/or alternative embodiment of the invention, the fret control bar can be positioned such that one or more frets are in a fully upward position. When the guitarist desires to play the guitar in a fretless manner, the fret control bar can be moved to a fretless position. In this position, the frets move to a position that is substantially flush with the upper face of the neck or below the surface of the upper face of the neck. In a further and/or alternative embodiment of the invention, the fret control bar is designed to only move between selected positions. In one aspect of this embodiment, a fret control handle is used to cause the fret control bar to rotate to one or more positions. The fret control handle allows the guitarist to easily control the fret position on the neck. In another and/or alternative aspect of this embodiment, the fret control handle can be moved by the guitarist while playing the guitar, thus allowing fret or fretless playing without having to pause or stop during the playing of a song. As can be appreciated, other mechanisms can be used to cause the fret control bar to rotate to one or more positions. In still a further and/or alternative embodiment of the invention, the fret control handle and/or fret control bar includes visual and/or tactile indicators to inform the guitarist of the landing, fret and/or fretless position. In yet a further and/or alternative embodiment of the invention, the fret control handle and/or fret control bar include locking mechanisms, frictional mechanisms, or the like to facilitate in retaining the fret control bar in a desired position.

In still a further and/or alternative aspect of the present invention, the main body includes one or more interchangeable pickups. The interchangeability of one or more pickups allow the guitarist to customize the guitar for a particular style or use. The pickups facilitate in setting the range of sound of the guitar when played. When the range of sound is needed or desired to be changed, the number of pickups are selected and/or the orientation of one or more pickups is selected on the guitar. In one embodiment of the invention, the main body includes a cavity that is designed to receive a pickup mounting box. The pickup mounting box orients a selected number of pickups in a particular position on the main body. In one aspect of this embodiment, the size of a plurality of pickup boxes is the same so that different pickup boxes can be easily and conveniently interchanged in the cavity of the main body. In another and/or alternative embodiment of the invention, the pickup boxes have a particular slot orientation to facilitate in maintaining in position a particular number of pickups in a particular orientation. In another and/or alternative embodiment of the invention, a securing arrangement is used to releasably secure the pickup box to the main body. The pickup box can be secured to the cavity of the main body in a number of ways such as, but not limited to, VELCRO, screws, bolts, latches, clamps, pins, locks, cables, and/or the like. In still another and/or alternative embodiment of the invention, a securing arrangement is used to releasably secure one or more pickups to the pickup box. The pickups can be secured to the pickup box in a number of ways such as, but not limited to, VELCRO, screws, bolts, latches, clamps, pins, locks, cables, and/or the like. In one non-limiting design, the pickup box cavity of the main body includes a clip that is designed to releasably connect the pickup to the main body.

In yet a further and/or alternative aspect of the present invention, one or more components of the guitar include interchangeable graphics that can be used to make minor or significant changes to the look of the guitar. In one embodiment of the invention, the headstock includes a graphics slot that is designed to receive a headstock graphic. The headstock graphic can be a colored component, a component having one or more designs, etc. The headstock graphic is designed to be releasably secured to the headstock so that other headstock graphics can be used. If the guitar includes a storage area, the headstock graphic can be stored in such storage area.

In one object of the present invention, a modular guitar is provided in accordance with the present invention.

Another and/or alternative object of the present invention is the provision of a modular guitar that has a main body that is releasably connected to a shell body.

Still another and/or alternative object of the present invention is the provision of a modular guitar that sandwiches a main body between two of more shell bodies.

Yet another and/or alternative object of the present invention is the provision of a modular guitar that has a main body that can be connected to a plurality of shell bodies.

Still yet another and/or alternative object of the present invention is the provision of a modular guitar that has a shell body that can be connected to a plurality of main bodies.

A further and/or alternative object of the present invention is the provision of a modular guitar that includes a neck that is hingably connected to another portion of the main body and/or shell body.

Still a further and/or alternative object of the present invention is the provision of a modular guitar that includes a neck that is detachably connected to another portion of the main body and/or shell body.

Yet a further and/or alternative object of the present invention is the provision of a modular guitar that includes a headstock that is detachably connected to a neck portion of the guitar.

Still yet a further and/or alternative object of the present invention is the provision of a modular guitar that includes a headstock having special string tensioners.

Another and/or alternative object of the present invention is the provision of a modular guitar that has a headstock protector.

Still another and/or alternative object of the present invention is the provision of a modular guitar that has a humidity tuner.

Yet another and/or alternative object of the present invention is the provision of a modular guitar that has a string tensioner near the base of the main body.

Still yet another and/or alternative object of the present invention is the provision of a modular guitar that controls the position of the frets.

A further and/or alternative object of the present invention is the provision of a modular guitar that has a reinforced neck.

Still a further and/or alternative object of the present invention is the provision of a modular guitar that has interchangeable pickups.

Yet a further and/or alternative object of the present invention is the provision of a modular guitar that can be easily converted into number of different styled and/or shaped guitars.

Still yet a further and/or alternative object of the present invention is the provision of a modular guitar that includes one or more storage areas.

Another and/or alternative object of the present invention is the provision of a modular guitar that includes one or more interchangeable graphics.

Still another and/or alternative object of the present invention is the provision of a modular guitar that is easily transportable.

Yet another and/or alternative object of the present invention is the provision of a modular guitar that can be made compact.

Still yet another and/or alternative object of the present invention is the provision of a modular guitar that is cost effective to use and/or own.

These and other objects and advantages will become apparent from the following description used to illustrate the preferred embodiment of the invention when read in conjunction with the accompanying drawings.

BRIEF DESCRIPTION OF THE DRAWINGS

Reference may now be made to the drawings, which illustrate various embodiments that the invention may take in physical form and in certain parts and arrangements of parts wherein;

FIG. 5 is an illustration of three different fret positions on the neck of the interchangeable guitar;

FIG. 6 is a top end view of the neck of the interchangeable guitar illustrating the fret setting controller;

FIG. 7 is a bottom end view of the neck of the interchangeable guitar illustrating a fret in a raised position;

FIGS. 8A and 8B are partial side views of the main body of the interchangeable guitar which illustrate two types of tension controllers;

FIG. 9 is a partial side view of the main body of the interchangeable guitar illustrating a humidity tuner connected between the neck and headstock;

FIGS. 10A and 10B are partial side views of the shell body and neck of the interchangeable guitar showing the neck in two positions connected to the main body of the guitar by a hinge;

BRIEF DESCRIPTION OF THE INVENTION

Figure 1:
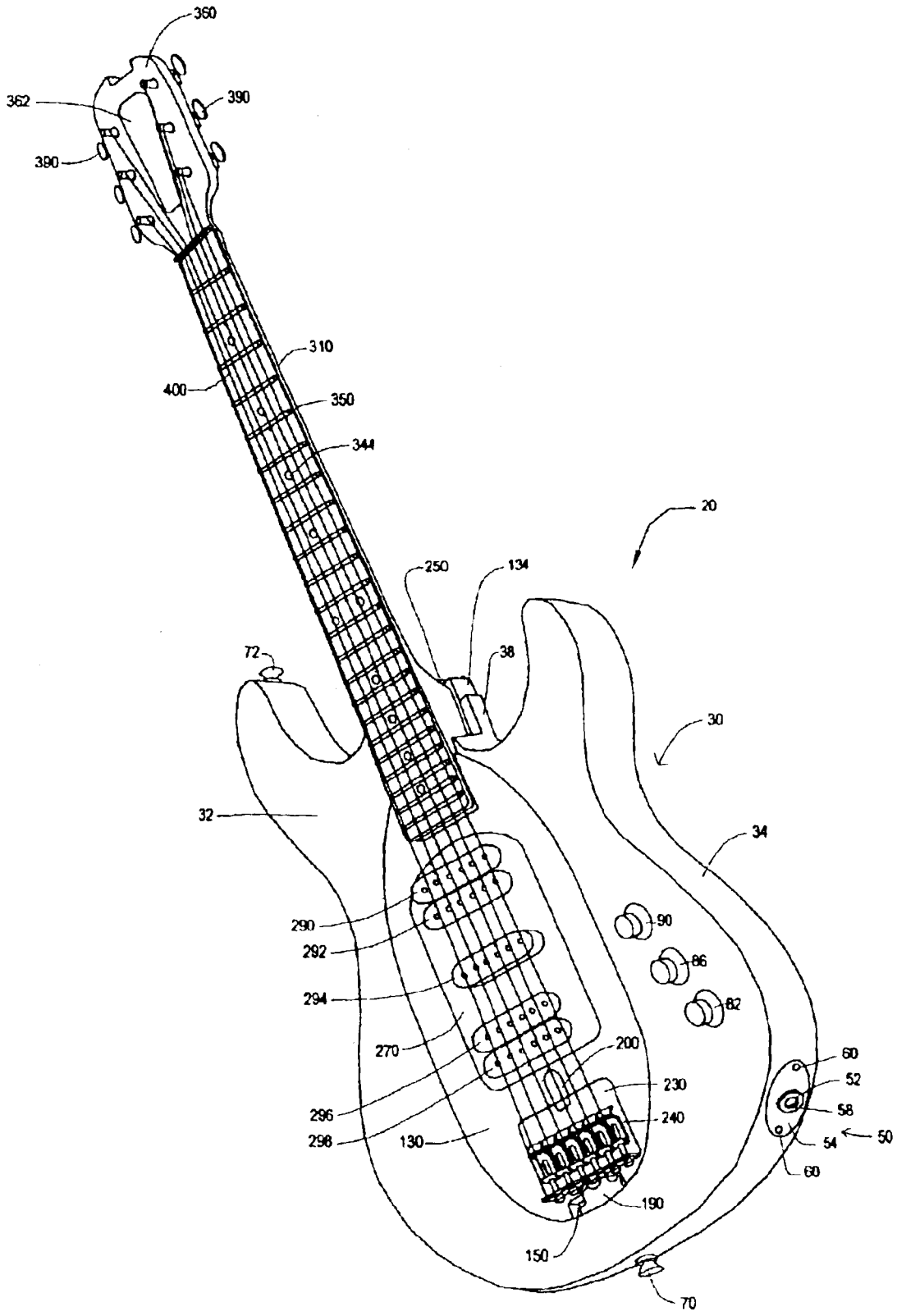
FIG. 1 is an elevation view of an interchangeable electric guitar in accordance with the invention.

Referring now to the drawings, wherein the showings are for the purpose of illustrating preferred embodiments of the invention only and not for the purpose of limiting the same, reference is first had to FIG. 1 which illustrate an electric guitar 20 which includes a shell body 30, a main body 130, a neck 310, and a headstock 360. In the fully assembled form, electric guitar 20 has the general appearance of a standard electric guitar. As can be appreciated, the invention is applicable to other types of electric guitars such as, but not limited to, bass guitars, steel guitars, multi-neck guitars (e.g., dual neck guitar, etc.), and the like. Unlike standard electric guitars, main body 130 of the present invention is detachably connected to shell body 30. This detachability of the main body from the shell body enables a guitarist to play the main body without a body shell or to substitute various other types of shell bodies with the main body to create a different style of guitar. This modular electric guitar significantly reduces the costs associated with having multiple guitar styles. One main body can be used with multiple styled shell bodies. In addition, the modular guitar allows a guitarist to quickly convert from one style of guitar to another style of guitar. As can be appreciated, the modular guitar also can reduce the storage space required for a particular guitar and/or set of different styled guitars.

Figure 2:
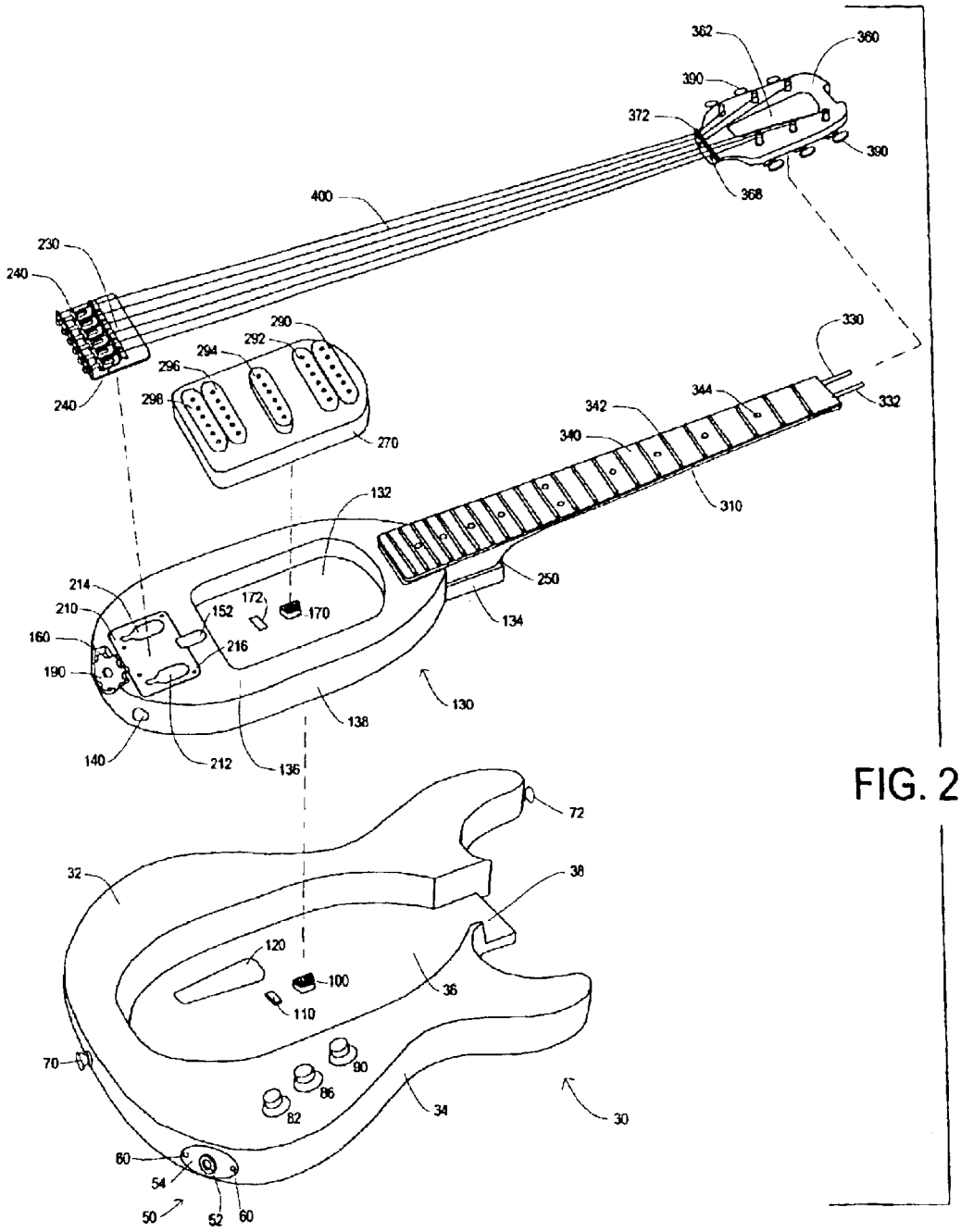
FIG. 2 is a partial exploded view of the interchangeable guitar shown in FIG. 1 which illustrates several of the principal components of the interchangeable guitar.
Figure 3:
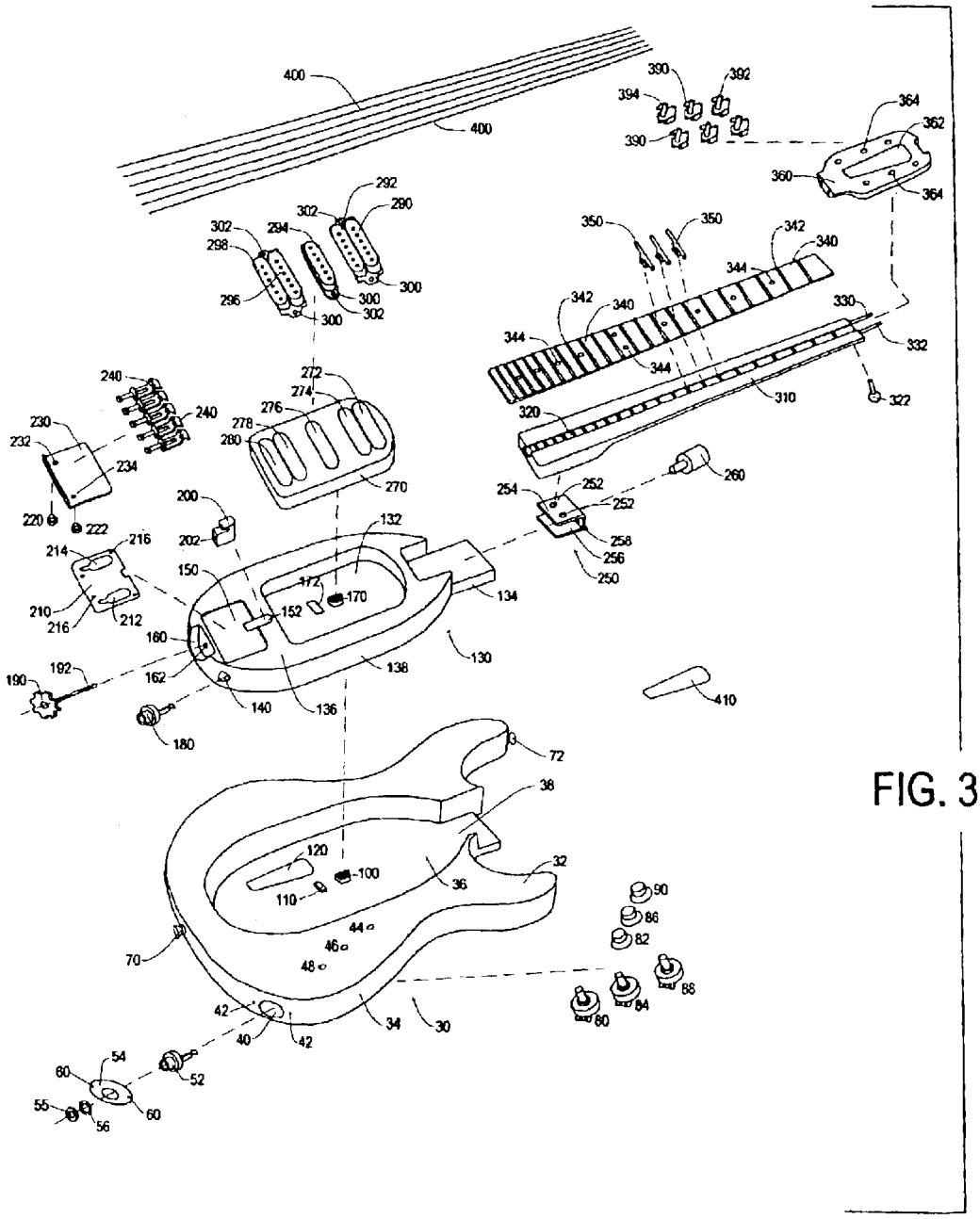
FIG. 3 is an exploded view of the interchangeable guitar shown in FIG. 1.

Referring now to FIG. 2, several of the modular components of the electric guitar are illustrated. The shell body 30 of the electric guitar includes an upper surface 32, a side surface 34, and a central cavity 36. The shell body can be made from a variety of materials such as, but not limited to, metals, plastics, woods, composite materials, etc. Typically, the shell body is formed from one or more pieces of wood. The upper surface of the shell body can include a variety of finishes and/or designs to obtain a desired look for the modular guitar. The upper surface of the shell body can include a pick guard to protect one or more surfaces of the shell body; however, this is not required. The shape of the shell body can be any one of a number of different shapes. Several examples of these shapes are illustrated in FIGS. 12A–12K, which will be further described below. Although the shape and design of the shell body can be widely varied, the shape of the central cavity 36 has a standard shape for each type of shell body. This standard shape allows main body 130 to be properly inserted and secured to the shell body. As illustrated in FIG. 2, the shell body includes an output jack 50 which is designed to be connected to an amplifier and/or other types of audio components. As illustrated in FIG. 3, the output jack includes a plug receiver 52, a plate 54, and a washer 56 and a nut 58 to secure the plug receiver in the output jack opening 40 of the shell body. Plate 54 can include one or more location indents 60 to be received in indents 42 on shell body 30. As can be appreciated, location indents 60 can be openings to receive a nail and/or screw to secure plate 54 to the side surface 34 of shell body 30. The side surface 34 of the shell body also includes two band studs 70, 72 which are designed to be hooked to a strap or belt for use in supporting the electric guitar on a user.

On the upper surface 32 of the shell body 30, there is illustrated three knobs 82, 86, and 90. Knobs 82 and 86 typically control the tone of the electric guitar and knob 90 typically controls the volume of the electric guitar. As illustrated in FIG. 3, knobs 82, 86, and 90 are connected to controllers 80, 84, and 88. The tops of the controllers extend through openings 44, 46, and 48 in upper surface 32 of shell body 30. As can be appreciated, more control knobs or less control knobs can be placed on shell body 30. For instance, a control knob can be used to control one or more special effects of the electric guitar. Furthermore, one or more control knobs can have multiple functions, wherein the control knob controls both the tone and/or volume of the guitar and/or the tone and/or volume of a particular pickup on a guitar. As can be appreciated, any type of electrical arrangement can be incorporated into the shell body and/or main body of the electric guitar to achieve the desired sound and/or effects of the electric guitar.

An electric connector 100 is positioned in central cavity 36 of the shell body 30. Electrical connector 100 is designed to be electrically connected to an electric connector 170 on main body 130. The electrical connectors are designed to send and/or receive signals and/or power to various components of the electric guitar.

A clip 110 is also positioned in central cavity 36 of shell body 30. Clip 110 is designed to facilitate in securing main body 130 in central cavity 36. Clip 110 is designed to be rotatable so as to engage and/or disengage the main body to the shell body. The clip can be rotated from the back surface of the shell body by the hand of the guitarist and/or be the use of a tool.

A graphic storage 120 is positioned in central cavity 36. Graphic storage 120 is designed to secure one or more headstock graphic strips, which can be secured to headstock 360 to alter the style and look of the electric guitar as desired.

Referring again to FIG. 2, main body 130 includes a top surface 136, a side surface 138, a pickup box cavity 132, and a bridge cavity 150. The shape of the main body 130 is standardized so that a single main body can be properly fitted and connected to a standardized sized central cavity of a variety of different shell bodies. The top surface of the main body can have a variety of finishes and/or designs to achieve the desired look for the electric guitar. One or more regions of the top surface may also include a pickup guard to protect the top surface of the main body during use of the electric guitar. The front of the main body has a front lip 134 that is designed to be connected to neck 310 of the electric guitar. When the main body 130 is releasably secured into the central cavity of shell body 30 by use of clip 110 and/or some other arrangement, a portion of the bottom surface of front lip 134 engages front lip 38 of shell body 30. The side surface of the main body includes a jack opening 140 that supports a jack 180. Jack 180 is designed to receive a plug to an amplifier, speaker, mixer, and/or other electric device. In some instances, the guitarist may desire to play the main body of the guitar without the shell body. Jack 180 allows for such play. As can be appreciated, the main body can also include one or more control knobs to control the volume and/or tone of the guitar in this configuration. Jack 180 is electrically connected to electric connector 170 positioned in pickup box cavity 132 and/or one or more other electrical components in the main body. As can be appreciated, output jack 180 is not used when electrical connector 170 is directly connected to electric connector 100 in shell body 130 while the main body is connected to the shell body.

The rear side surface of the main body includes a knob cavity 160 and a knob opening 162. Knob opening 162 is designed to receive a threaded end 192 of a bridge clamping knob 190. Knob opening 162 opens up into bridge cavity 150 and is designed to extend at least partially into clamping slot 152. Clamping slot 152 is designed to partially guide a bridge clamping lock 200 which is secured to the end of threaded end 192 of bridge clamping knob 190 through a threaded opening 202 in the bridge clamping lock. Bridge mounting plate 210 is secured in the top portion of bridge cavity 152 by inserting one or more screws, nails, etc., through mount openings 216 in the bridge mounting plate. Bridge mounting plate 210 includes two plate slots 212, 214. The two slots each have a wide portion and a narrow portion that are designed to secure bridge plate 230 to bridge mounting plate 210.

As shown in FIG. 2, a pickup box 270 is designed to be inserted into pickup box cavity of main body 30. Pickup box 270 includes five box slots 272, 274, 276, 278, and 280, which are designed to receive five pickups 290, 292, 294, 296, and 298. The pickups include pickup flanges 300 having flange openings 302 which are designed to be connected to the pickup box, thereby securing the pickups within the box slots of the pickup box. The bottom of the pickup box includes an electrical connector, not shown, which is designed to connect to electrical connector 170 in pickup box cavity 132 of main body 130. The electrical connection allows for signals and/or power to be sent to and/or from one or more pickups on the pickup box. Pickup box 270 can be secured in pickup cavity 132 in a variety of ways. Typically, the pickup box is releasably connected to the main body such as by, but not limited to, clamps, screws, friction fit, etc. As illustrated in FIG. 2, the pickup box cavity 132 includes a clip 172 that can be used to releasably secure the pickup box to the pickup box cavity. Clip 172 can be rotatable so as to lock and unlock the pickup box in the pickup box cavity. The clip can be rotated from the bottom surface of the main body by a hand and/or a tool. As can be appreciated, the clip can be designed to be rotated by other arrangements. As can be appreciated, the pickup box can be permanently secured in the main body by various arrangements such as, but not limited to, adhesive, nails, etc.

Figure 11:
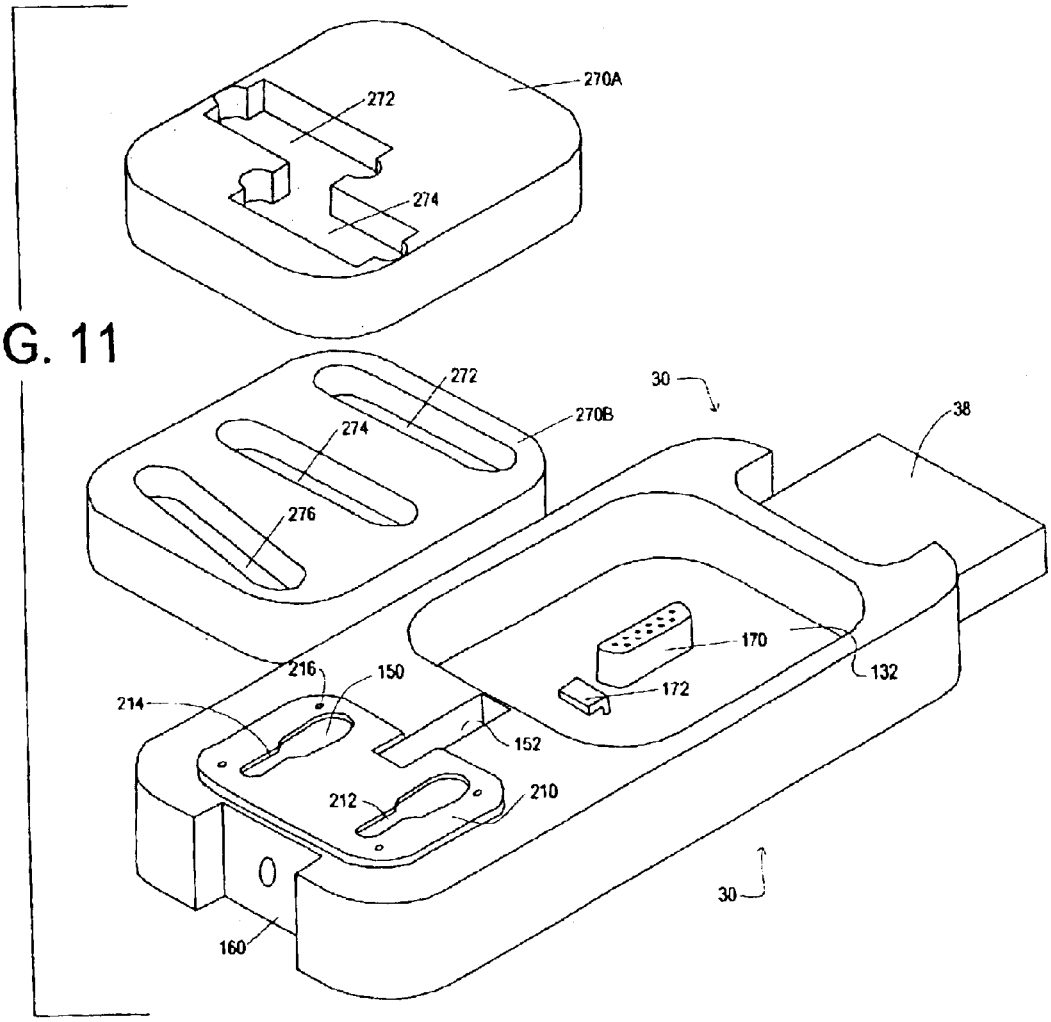
FIG. 11 is an exploded view of the pickup box and two types of pickup carriages.

Referring now to FIG. 11, there are illustrated two configurations of a pickup box 270A, 270B, having different numbered and configured box slots. Pickup box 270A includes two box slots 272, 274 which are arranged close together. Pickup box 270 includes three box slots 272, 274, 276 which are arranged in a more spaced-apart configuration. These two pickup box configurations illustrate that a wide variety of different pickup box configurations can be used to obtain the desired pickup configuration on the main body of the guitar. The pickup boxes illustrated in FIG. 11 are designed to be releasably connected within pickup box cavity 132 of main body 130 so that a variety of different pickup boxes can be substituted within the main body to obtain the desired sound and/or tonal quality of the electric guitar during a particular use. As illustrated in FIG. 11, the shape of pickup boxes 270A, 270b are substantially the same so as to properly be fitted within pickup box cavity 132.

Referring now to FIGS. 2 and 3, neck 310 is illustrated as being connected to front lip 134 of main body 130 by a neck hinge 250. Neck hinge 250 includes a top component 254 having two openings 252 and a bottom component 256. The top component is adapted to be secured to the front bottom surface of neck 310 by inserting screws, nails, and/or the like through openings 252 and into the bottom surface of neck 310. Bottom component 256 is designed to be secured to front lip 134. The bottom component can be secured to the front lip is a variety of manners such as, but not limited to, being positioned in a slot in the lip, screwed to the lip, nailed to the lip, adhesively connected to the lip, and the like. A hinge 258 hingably connects the top component and bottom component together.

As illustrated in FIGS. 10A and 10B, hinge 250 allows the neck to be pivotally moved relative to the main body 130. As shown in FIG. 10A, neck 310 is positioned in an extended position wherein top component 254 rests on the top surface of front lip 134 of main body 130. As illustrated in FIG. 10B, the neck is positioned in the folded position wherein the bottom surface of main body 130 is positioned substantially parallel with the bottom surface of the neck. In the folded position, the length of the connected main body and neck is reduced to thereby facilitate in the convenient storage and/or transport of the modular guitar. A hinge lock 260 is used to secure neck 310 in an extended position. The hinge lock 260 can also be used to secure the neck on a folded position. Hinge lock 260 can include a threaded end which is inserted into an opening 262 in top component 254 and threaded into an opening in the end of front lip 134, not shown, to thereby maintain neck 310 in an extended position. As can be appreciated, hinge lock 260 can be connected to the neck in other manners and/or take many other forms. In addition, neck hinge 250 can be secured in an extended and/or folded position in a number of different arrangements.

Figure 4A:
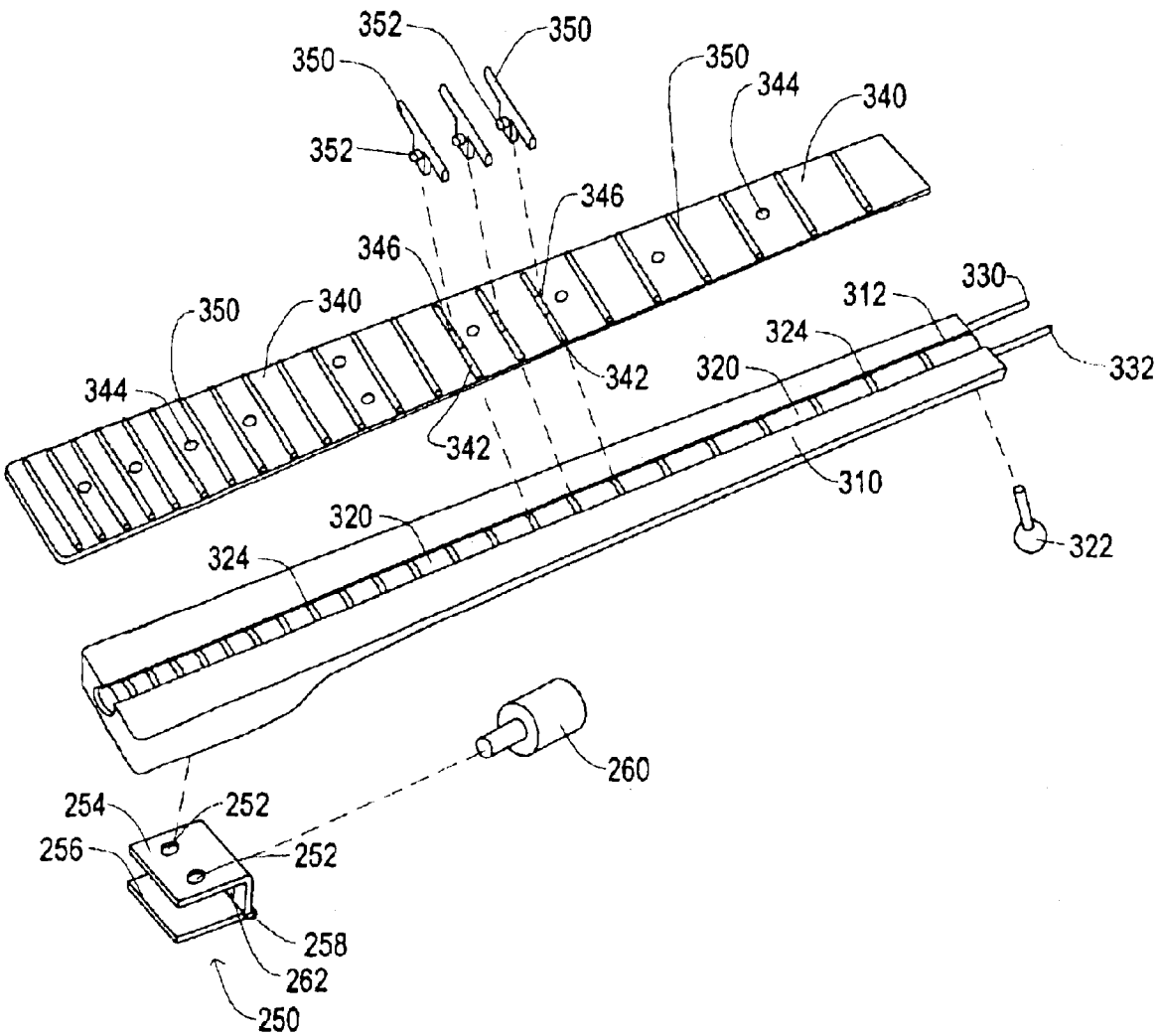
FIGS. 4A and 4B are exploded views of the neck of the interchangeable guitar shown in FIG. 1.
Figure 4B:
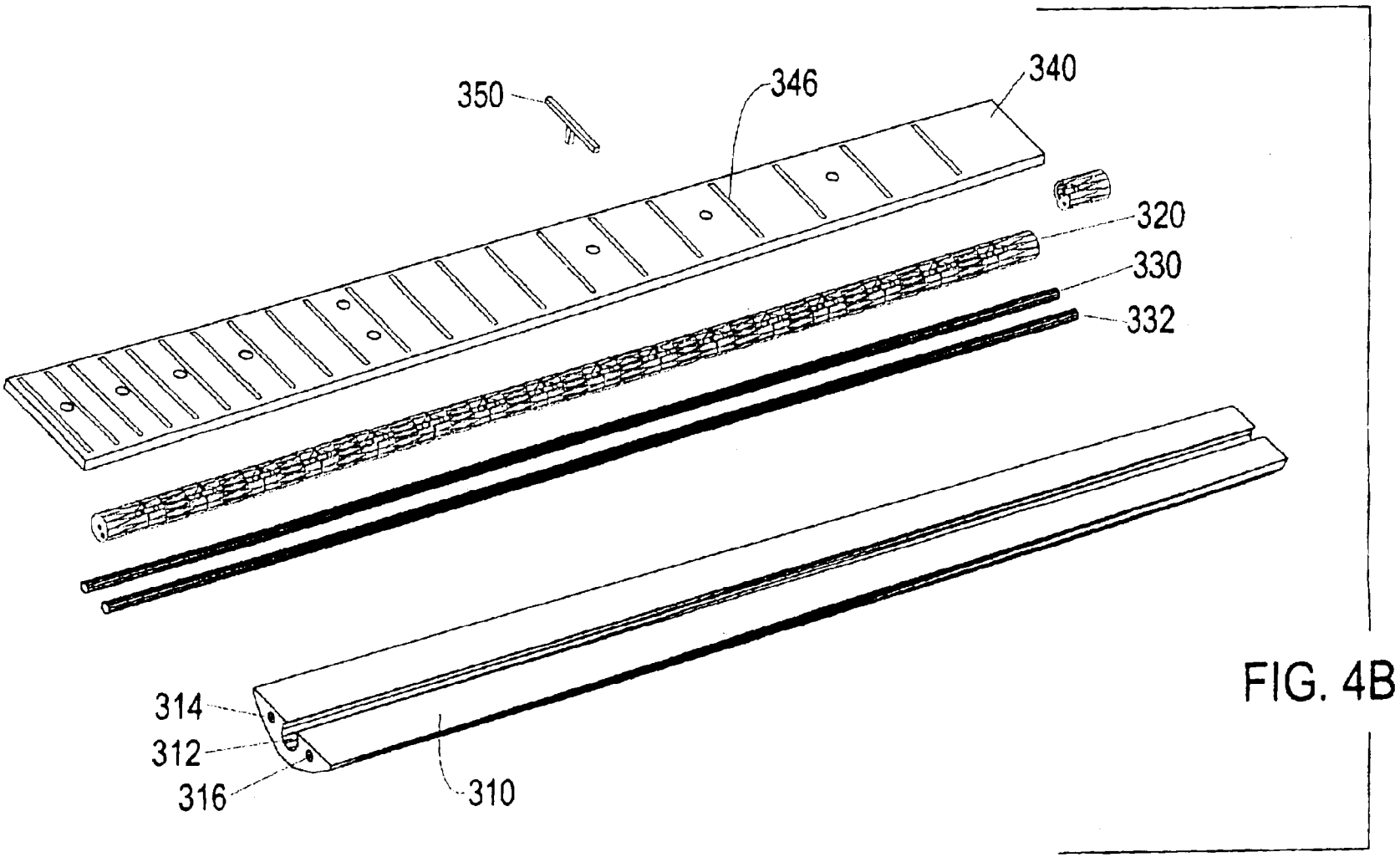

Referring now to FIGS. 4A and 4B, neck 310 includes a fret cavity 312 extending centrally along the longitudinal length of the neck. The shape of the fret cavity is such so as to secure a substantially cylindrically shaped fret control bar 320 within the neck cavity. Neck 310 also includes two truss openings 314, 316 which at least partially extend along the longitudinal length of the neck. The two truss openings are designed to receive truss rods 330, 332 which are used to provide strength and rigidity to neck 310. Typically, the truss rods are made of a strong and rigid material such as metal, plastic, composite materials, and the like; however, other materials can be used. Positioned on the top surface of neck 310 is a fingerboard 340. Fingerboard 340 can be releasably or permanently secured to the top of the neck in a variety of manners. Fingerboard 340 includes several fret slots 342 having openings 346 therethrough to receive frets 350. Fingerboard 340 also includes several fret markers or position markers 344 along the length of the fingerboard. The positioning and use of these fret markers are well known in the art, thus will not be further described.

As illustrated in FIG. 4A, the bottom portion of frets 350 are designed to be inserted through fret openings 346 of fret slots 342. The bottom portion of the frets include a fret node 352 that is designed to be positioned within bar slots 324 in fret control bar 320. As illustrated in FIGS. 5–7, fret control bar 320 is designed to control the position of the frets relative to the top surface of the fingerboard. As illustrated in FIG. 5A, fret control bar 320 is shown to be rotated to a load position to load fret node 352 into bar slots 324 in fret control bar 320. Once the fret nodes of each of the fret is loaded into slots 324, the fret control bar is rotated to the fully raised position by fret control knob 322 as illustrated in FIG. 5B. Typically, the fret control bar is not allowed to be repositioned in the position shown in FIG. 5A once the fret nodes are loaded into the bar slots. As illustrated in FIGS. 5B and 7, the top surface of fret 350 is positioned in a fully raised position. As illustrated in FIGS. 5C and 6, when the fret control bar is rotated about a half-turn by fret control rod 322, the top surface of fret 350 becomes planar with or is positioned slightly below the top surface of fingerboard 340. When the frets are in this position, the electric guitar is converted into a fretless guitar. The movement of the frets relative to the top surface of the fingerboard is accomplished by the interaction between the nodes 352 on frets 350 and the slots within control bar 320. As best illustrated in FIG. 5, slot 324 is configured so as to start at or near the outer surface of the fret control bar and move toward the center of the fret control bar along the length of the slot. Fret nodes 352 are positioned within the slot and thus move within the slot as the fret control bar is rotated. Consequently, the user of the guitar can control the position of the frets relative to the fingerboard by the mere use of moving the fret control knob 322 at any time while playing the guitar. As can be appreciated, the fret control bar 320 can be rotated at a position between the fully raised position and the fretless position.

Referring now to FIGS. 1–3, a headstock 360 is connected to the rear end of neck 310. Headstock 360 includes a graphic slot 362 on the upper surface of the headstock which is designed to receive a headstock graphic, not shown. As can be appreciated, the graphic slot can be eliminated from the headstock. Headstock 360 also includes several tuner openings 364 which are designed to receive pins 392 of tuners 390. The front end of headstock 360 also includes two truss openings 314, 316 which are designed to receive the ends of truss rods 330, 332, respectively. Headstock 360 is designed to be releasably connected to the end of neck 310; however, it can be appreciated that headstock 360 can be connected in a non-releasable manner. Pins 392 of tuners 390 are designed to be each connected to a string 400. Pegs 394 on the tuners are designed to cause the pins to rotate, thereby increasing or decreasing the tension on a particular string in order to tune a particular string.

Referring now to FIG. 9, a humidity tuner 480 is positioned between the back end of neck 310 and the front end of headstock 360. Humidity tuner 480 is designed to adjust the tension on strings 400 in response to changes in humidity and/or temperature in a particular environment. The humidity tuner includes a guide flange 382 which is secured to the rear end of neck 310. Guide flange 382 is designed to provide some guidance to the headstock as it is moved relative to the end of neck 310. Humidity tuner 480 also includes a control knob 384 having a threaded end 386. Threaded end 386 is designed to enter opening 370 on headstock 360. Control knob 384 is rotatably mounted on guide flange 382. In operation, control knob 384 is rotated to cause the end of headstock 360 to approach or recede from the end of neck 310, thereby causing the strings to reduce or increase in tension, respectively, thus providing quick and convenient tuning adjustment of the guitar in a various number of environments. As can be appreciated, humidity tuner 480 is an optional feature of the modular guitar, thus can be eliminated from the guitar.

Referring now to FIGS. 1–3, strings 400 are illustrated as being connected between headstock 360 and bridge plate 230. Bridge plate 230 includes a back flange having one or more openings, not shown, which are used to secure a plurality of intonation sliders 240 to the bridge plate. The intonation sliders are used to connect one end of a string 400. Bridge plate 230 also includes two plate openings 232, 234 which are designed to receive bridge pins 220, 222. The heads of the two bridge pins are spaced from the bottom surface of the bridge plate and are designed to be inserted into the large width portion of plate slots 212, 214 in bridge mounting plate 210 and to be locked onto the bridge mounting plate when moved rearwardly to the narrow portion of the plate slots. The spacing of strings 400 from one another is maintained by the spacing of the intonation sliders and the nut 372 on headstock 360. As illustrated in FIGS. 1 and 2, six strings are mounted between headstock 360 and bridge plate 330. As can be appreciated, more or fewer strings can be used to obtain a specific configuration for the electric guitar.

Referring now to FIG. 8A, one particular arrangement is disclosed for securing and/or releasing bridge plate 230 from bridge mounting plate 210. As illustrated in FIG. 8A, bridge clamping lock 200 is designed to engage one end of bridge plate 230 and to cause the bridge plate to move relative to bridge mounting plate 210 as bridge clamping knob 190 is rotated. The rotation of bridge clamping knob in one direction will cause bridge clamping lock 200 to move toward the bridge clamping knob, thereby causing bridge plate 230 to move rearwardly. The rearward movement of bridge plate 230 results in the tensioning of strings 400 and further results in bridge pins 220, 222 moving into and/or further within the narrow portion of plate slots 212, 214 of bridge mounting plate 210. The movement of the bridge pins 220, 222 into the narrow portion of plate slots 212, 214 results in the locking of bridge plate 230 to bridge mounting plate 210. The rotation of bridge clamping knob 190 in the opposite direction causes bridge clamping lock 200 to recede from bridge clamping knob 190, thereby resulting in the bridge plate 230 retracting from the end of main body 130. When bridge clamping lock 200 has moved to a sufficiently retracted position, bridge pins 220, 222 on bridge plate 230 move to or can be moved to the wider slot opening of plate slots 212, 214, thereby allowing bridge plate 230 to be removed from bridge mounting plate 210. As can be appreciated, when this particular mounting/dismounting arrangement for the bridge plate on the bridge mounting plate is used, a humidity tuner as illustrated in FIG. 9 can be eliminated, since the slight rotation of the bridge clamping knob 190 can facilitate in adjusting the tension of the strings as necessary.

Figure 8B:
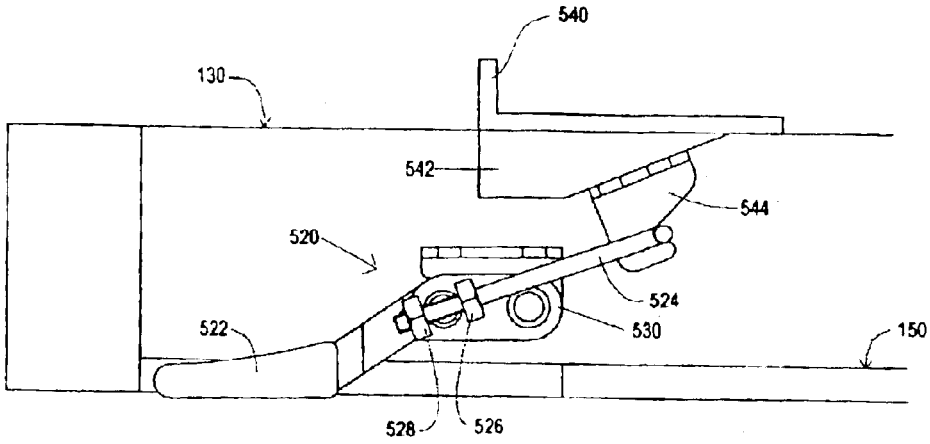

Referring now to FIG. 8B, another particular arrangement is disclosed for securing and/or releasing a bridge plate from the main body. As illustrated in FIG. 8B, a clamp 520 is used to secure and/or release bridge plate 540 on main body 130. Clamp 520 includes a lever arm 522 that is pivotably connected to cam or crank arrangement 530. A tension rod 524 is also connected to the cam or crank arrangement 530 at one end of the tension rod. The other end of the tension rod is connected to a rod hook 544 positioned on the base 542 of bridge plate 540. As previously illustrated in FIGS. 2 and 3, intonation sliders are secured to the bridge plate and the strings are secured to the intonation sliders. The clamp is designed to be positioned in and secured to the bridge cavity; however, this is not required. The lever arm of the clamp is used to move the bridge plate into a locked tension position or into a release position. FIG. 8B illustrates the clamp in a locked or tensioned position on main body 130. The lever arm is positioned in the down or locked position and the bridge plate is in a locked tension position. The bridge plate is released from the main body by simply lifting lever arm 522 to move the lever arm into an unlocked position. The upward movement of the lever arm results in the cam or crank arrangement 530 causing the tension arm to move rearwardly which in turn results in the bridge plate also moving rearwardly into an non-tensioned position. The rod hook on the base plate can then be disengaged from the tension rod thereby allowing the bridge plate to be removed from the main body. When the bridge plate is to be secured to the main body, the tension rod of the clamp is positioned in the rod hook of the bridge plate. The clamp arm is then pressed downwardly until the lever arm engages or is positioned near the top surface of the bridge cavity. The pushing of the clamp lever downwardly causes the tension rod to move toward the front end of the main body which in turn also causes the bridge plate to move toward the front of the main body and into a tensioned position. The tension of the strings connected to the bridge plate can be adjusted by nuts 526, 528 which are threaded on tension rod 524. As can be appreciated, the bridge plate securing arrangements illustrated in FIGS. 8A and 8B are only two of many securing arrangements that can be used to secure the bridge plate to the main body of the guitar.

Figure 12A:
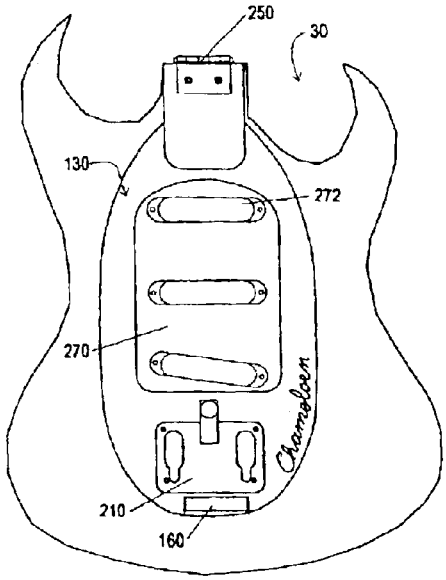
FIGS. 12A–12K are elevation views of various shell body configurations.
Figure 12B:
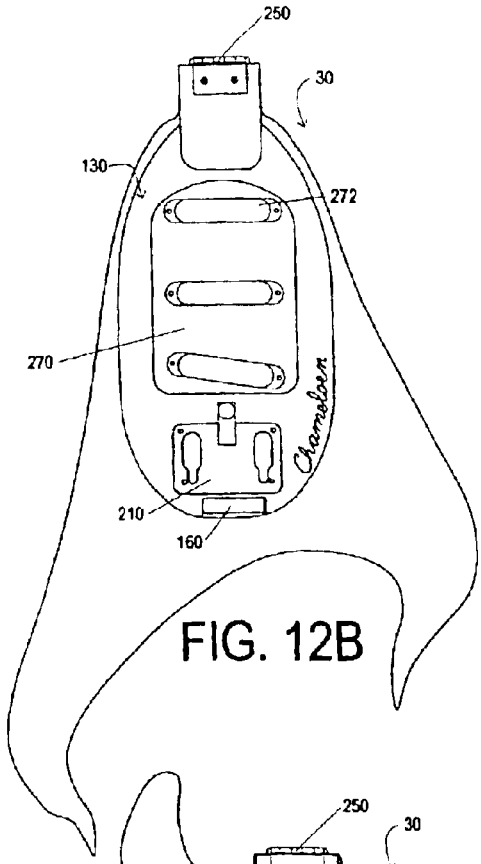
Figure 12C:
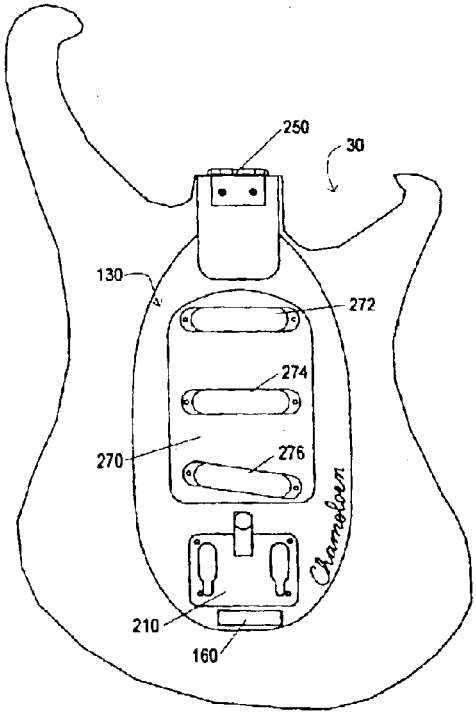
Figure 12D:
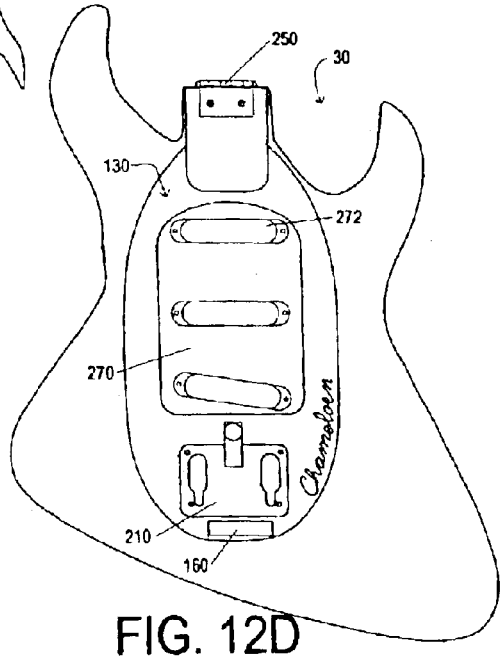
Figure 12E:
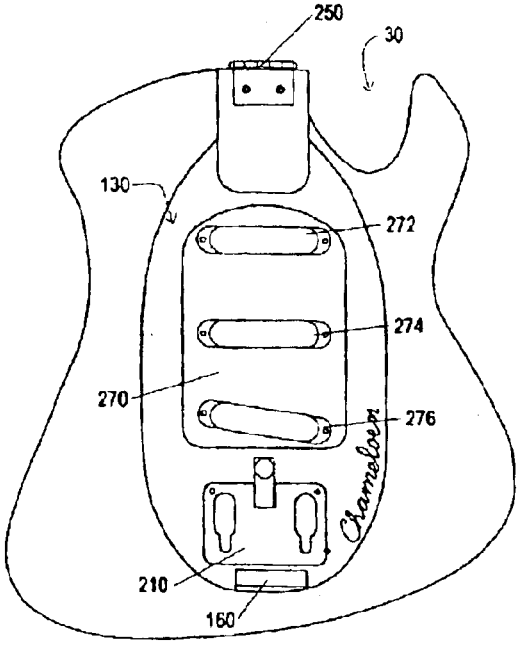
Figure 12F:
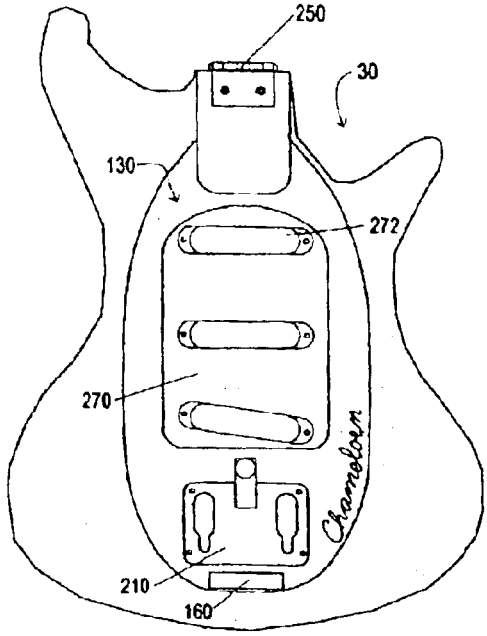
Figure 12G:
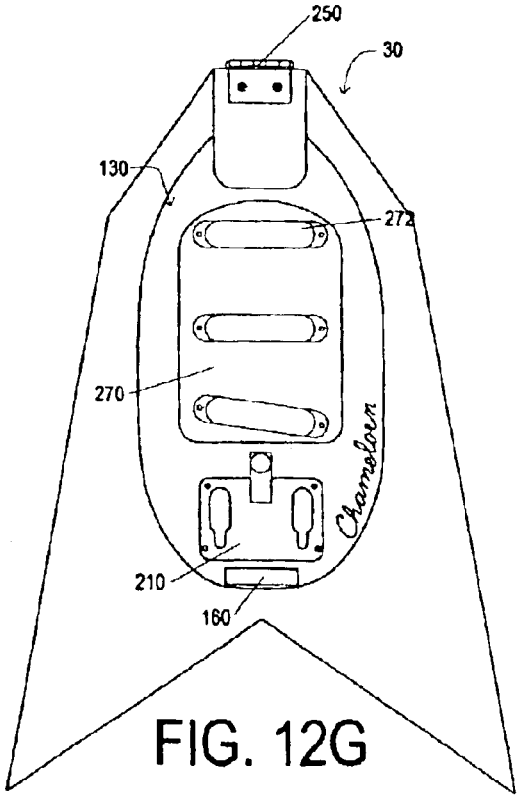
Figure 12H:
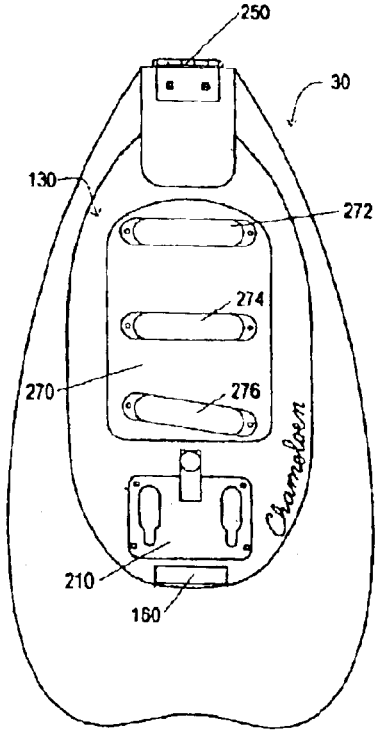
Figure 12I:
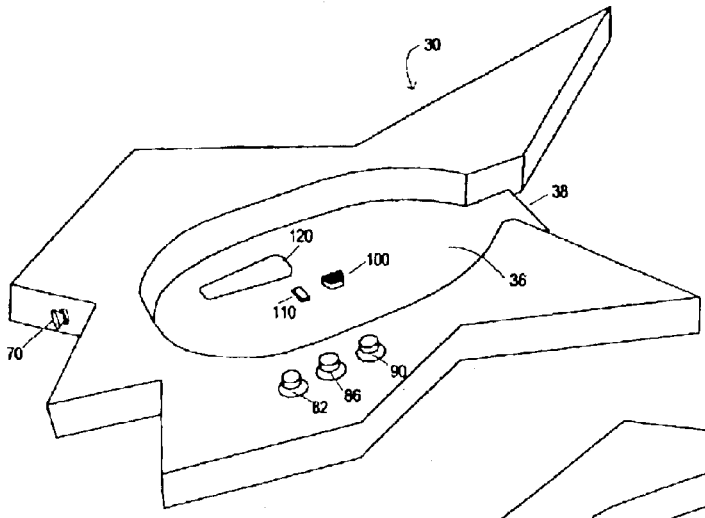
Figure 12J:
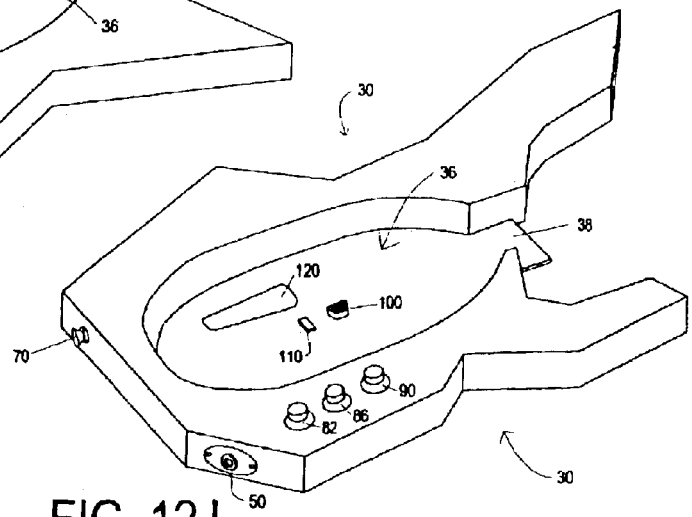
Figure 12K:
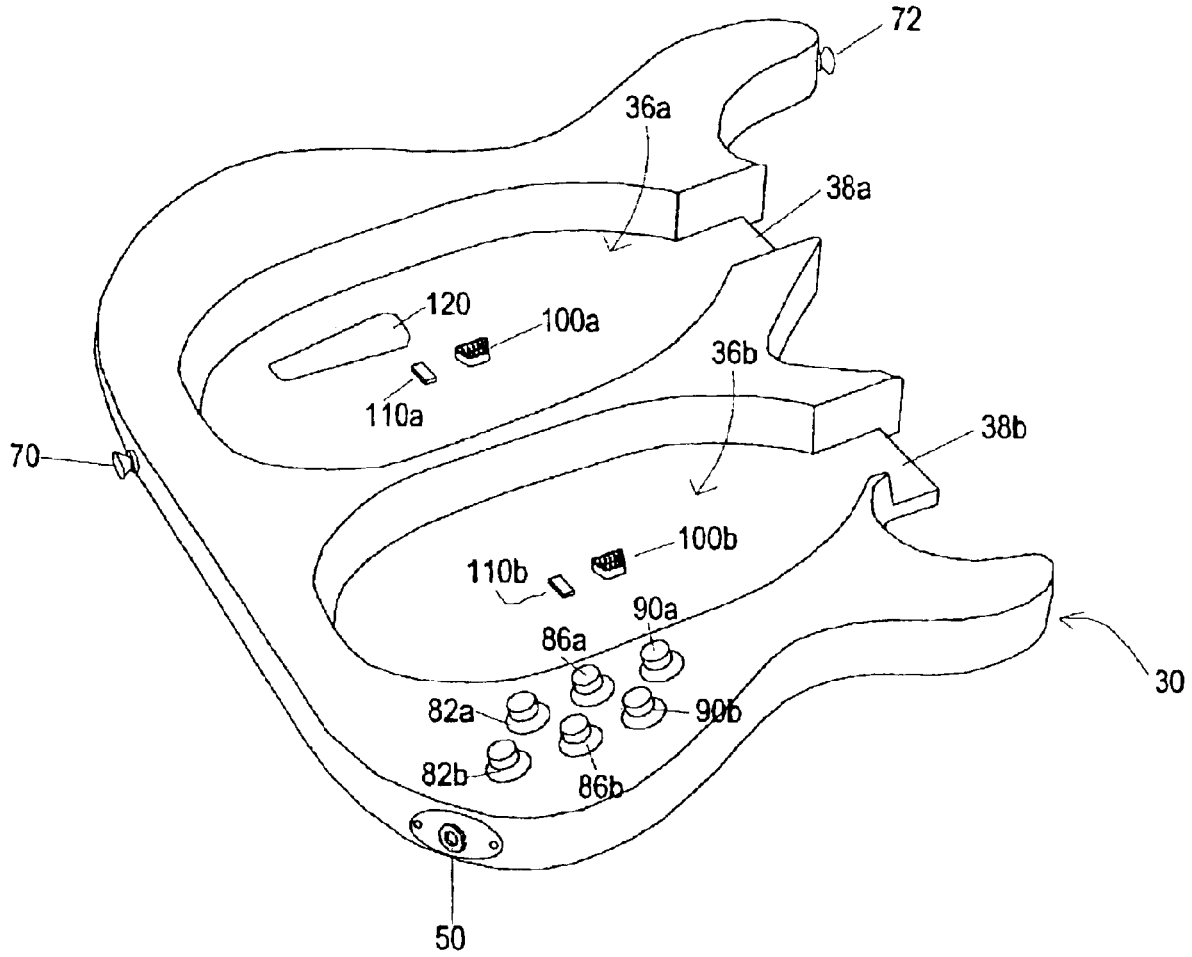

The disassembly and reassembly of the modular electric guitar disclosed in FIGS. 1 and 2 will now be briefly described. As illustrated in FIG. 1, modular electric guitar 20 is in its fully assembled form. The electric guitar as assembled has a six string configuration and five pickups. The modular electric guitar is designed such that the pickup arrangement can be quickly changed, the string arrangement of the electric guitar can be quickly changed, and/or the shell body can be quickly changed. Main body 130 is connected to shell body 30 by inserting main body 130 into central cavity 36 and then rotating clip 110 to lock main body 130 into central cavity 36. Typically, a key or other device is used to rotate clip 110 from the bottom surface of shell body 30. As can be appreciated, main body 130 can be releasably connected to shell body 30 in many other arrangements. When the main body needs to be removed from shell body 30, clip 110 is rotated and main body 130 is lifted from central cavity 36. A new shell body 30 can be then connected to main body 130 if desired. Several examples of shell bodies are disclosed in FIGS. 12A–12K. FIGS. 12A–12H illustrate several different shaped shell bodies with the main body connected thereto. FIGS. 12I–12J illustrate two additional shapes for the shell body without the main body connected to the shell body. FIG. 12K illustrates a shell body that can be connected to two main bodies to form a dual neck guitar. As illustrated in FIGS. 12A–12K, all the central cavities of the various shell bodies have substantially the same shape, thus a single main body can be fitted into each one of the illustrated shell bodies. As can be appreciated, many other styles of shell bodies can be designed and connected to main body 130.

The string configuration and/or pickup configuration can also be easily and conveniently changed. When needed, the string configuration can be changed while the main body is secured in the shell body, or can be changed while the main body is detached from the shell body. When changing the string configuration, bridge clamping knob 190 is rotated to thereby cause bridge clamping lock 200 to retract from bridge clamping knob 190 until bridge plate 230 can be removed from bridge mounting plate 210. Once bridge plate 230 is removed from bridge mounting plate 210, headstock 360 is slid off of the ends of truss rods 230, 232, thereby removing the headstock, bridge plate, and strings from the guitar. A new string configuration which includes a headstock for such configuration and a bridge plate for such configuration can then be easily and quickly reconnected to the guitar. This is accomplished by first sliding the new headstock 360 onto the end of truss rods 330, 332 and then positioning bridge plate 230 onto bridge mounting plate 210 such that the bridge pins 220, 222 are inserted into plate slots 212, 214, respectively. Bridge clamping knob 190 is then rotated to cause bridge clamping lock 200 to move toward bridge clamping knob 190, thereby causing the bridge pins 220, 222 to move into the narrow width portions of plate slots 212, 214, thus causing bridge plate 230 to be locked into bridge mounting plate 210. The bridge clamping knob 190 continues to be rotated until the desired tension of strings 400 is obtained. Pegs 394 on tuners 390 are then adjusted until the desired tension of each string is obtained, thus completing the replacement of a new string configuration on the guitar. A different pickup arrangement can also be replaced on the main body of the guitar while the bridge plate 230 is disengaged from bridge mounting plate 210. To remove pickup box 270 from pickup box cavity 132 on main body 130, clip 172 is rotated with the use of a key or other device located on the back side of main body 130. As can be appreciated, pickup box 270 can be secured in pickup box cavity 132 in a variety of other manners such as, but not limited to, pressure fit, bolts, clamps, etc. When clip 172 is rotated to the released position, pickup box 270 can then be removed and a differently configured pickup box can be reinserted and locked into place by re-rotating clip 172. After the new pickup box 270 is inserted into pickup box cavity 132, bridge plate 230 can then be secured to bridge mounting plate 210 as described above.

When the modular guitar is to be packed in a compact carrier, main body 130 is released from shell body 30 as described above. In addition, bridge plate 230 is disengaged from bridge mounting plate 210 and headstock 260 is disengaged from the end of neck 310 as described above. Neck 310 is then positioned in the folded position by removing hinge lock 260 and rotating neck 310 about hinge 258 so as to place the neck and main body in a more compact configuration. The pickup box 270 on main body 130 can remain on the main body or can be removed if so desired. The components of the modular guitar can then be packaged in a significantly smaller carrier for convenient storage and/or transport.

When the modular guitar has been assembled for playing, as illustrated in FIG. 1, the user of the guitar can connect the guitar to a shoulder band, not shown, by use of band studs 70, 72 on shell body 30. While playing the guitar, the user can adjust the volume and/or tone and/or other effects of the electric guitar by the use of knobs 82, 86, and 90. The user can also tune the strings of the guitar by applying a universal tension using the bridge clamping knob 190 and/or by individually tuning the strings by use of tuners 390 on headstock 360. The user can also adjust the fret position on the neck of the guitar by the use of fret control knob 322.

Figures 13A, 13B:
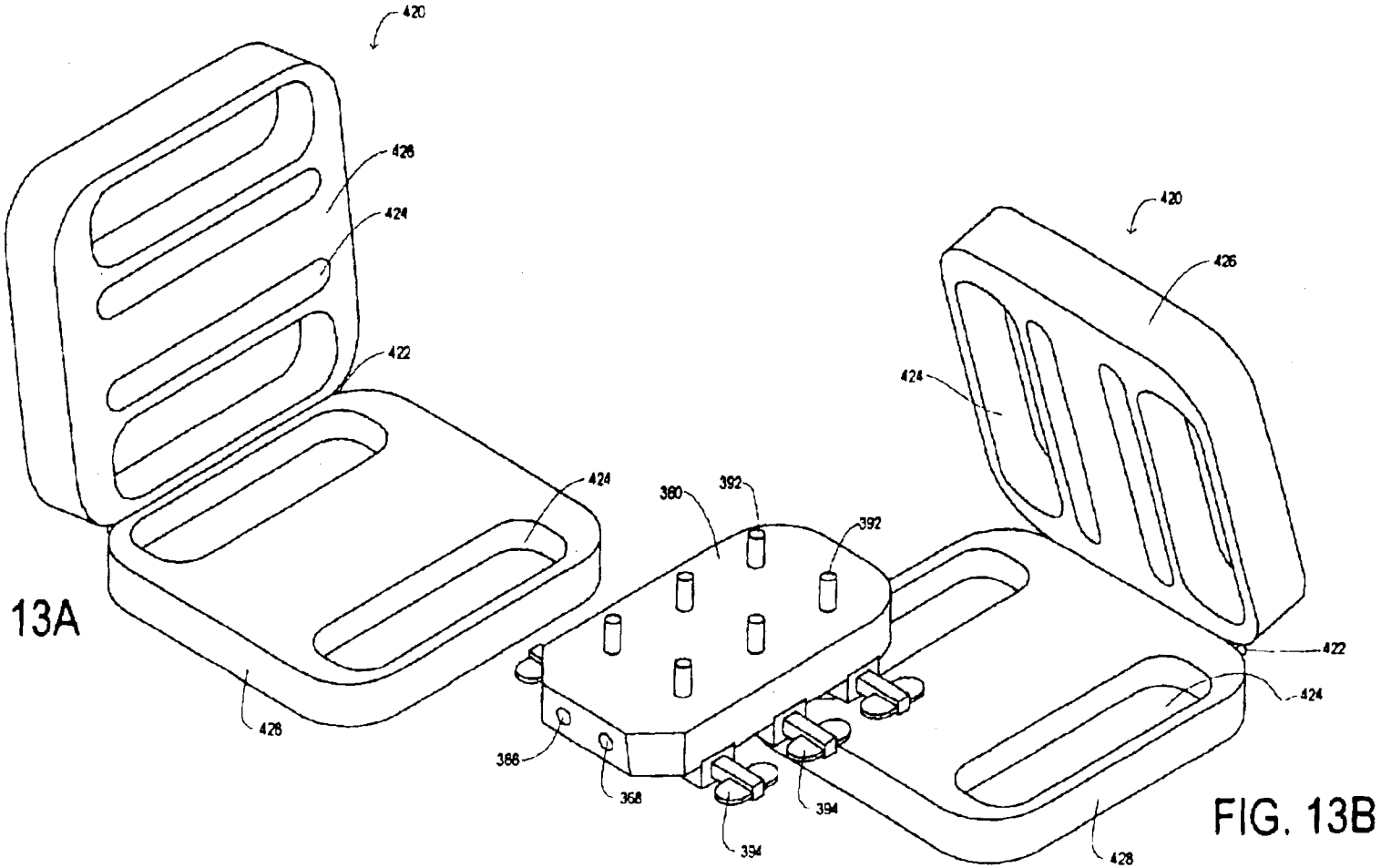
FIGS. 13A and 13B are elevation views of two types of headstock protectors.

Referring now to FIGS. 13A and 13B, two configurations of a headstock protector 420 are illustrated. The headstock protectors in both FIGS. 13A and 13B include a top component 426 and a bottom component 428 which are hingably secured together by a flexible material or hinge 422. The top and bottom component 428 also includes slots 424 which are designed to receive pins 392 of tuners 390 and/or pegs 394 of tuners 390. Headstock protector 420 is typically made of a durable material designed to protect the components of the headstock and thereby reduce the tendency of the strings connected to the headstock from becoming untuned by the inadvertent bumping of the pins and/or pegs on the headstock during packaging and/or reassembly of the guitar.

Figure 14:
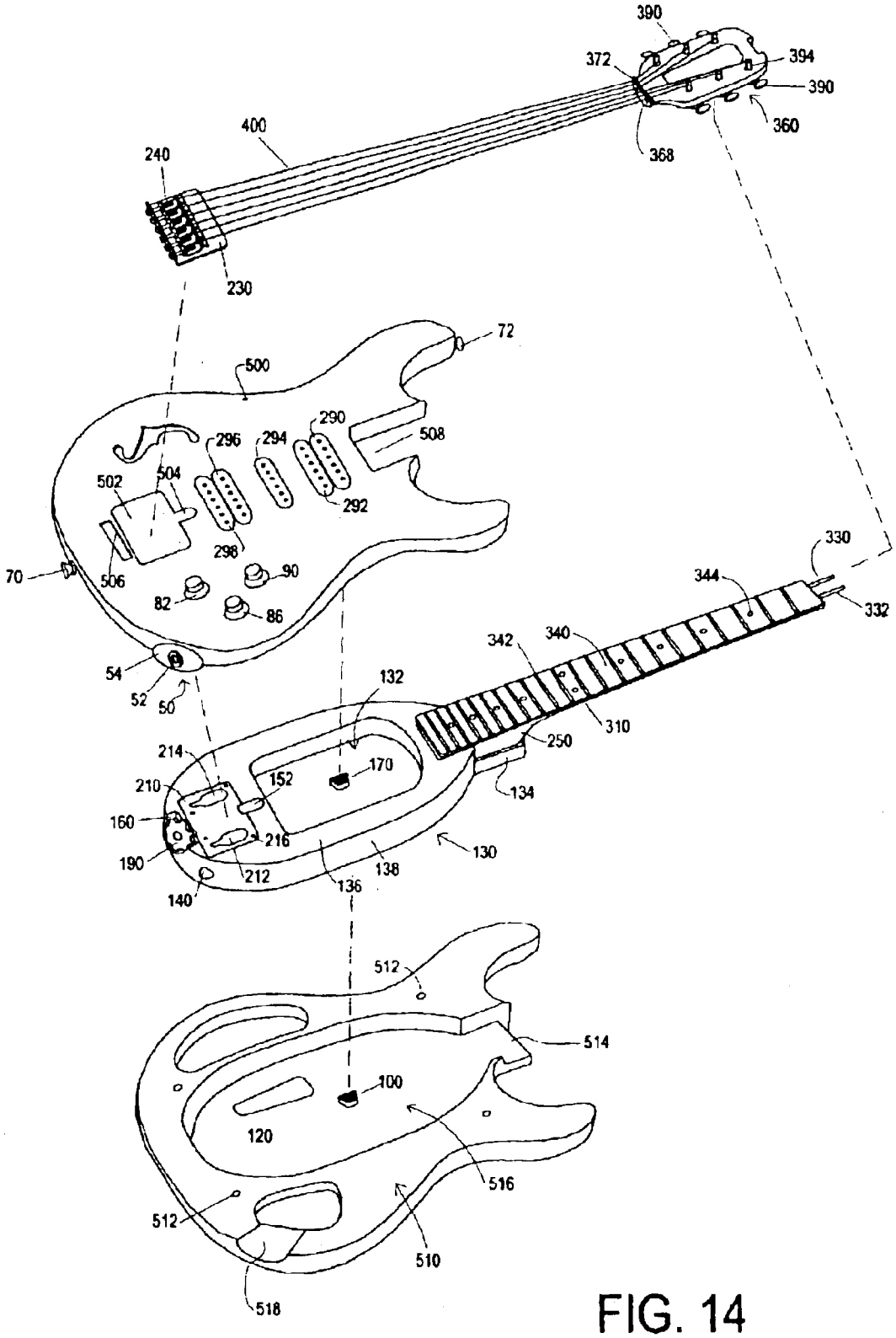
FIG. 14 is a partial exploded view of another embodiment of the interchangeable electric guitar in accordance with the invention.

Referring now to FIG. 14, an alternative embodiment of the invention is illustrated. As shown in FIG. 14, all the components of the modular guitar are the same as illustrated in FIGS. 1–3, except that the shell body is divided into two components and the pickup box is integrated with one of the components of the shell body. The shell body illustrated in FIG. 14 includes a top shell body 500 and a bottom shell body 510. Top shell body 500 includes an output jack 550 and its various components, control knobs 82, 86, and 90, and band studs 70 and 72, which components all are similar those disclosed with respect to FIGS. 1–3. Top shell body 500 also includes a bridge cavity opening 502 and a clamping slot 504. Positioned rearwardly of the bridge cavity is a knob slot 506. The orientation of bridge cavity 502 and clamp slot 504 are such to allow bridge plate 230 to be connected to bridge mounting plate 210 when top shell body 500 is positioned over main body 130 and secured to bottom shell body 510. In addition, knob slot 506 is oriented to allow access to bridge clamping knob 190 when top shell body 500 is placed over main body 130 and secured to bottom shell body 510. Although not shown; pickup box 270 is secured to the bottom surface of top shell body 500. Top shell body 500 also includes several openings for pickups 290. 292, 294, 296, 298. Top shell body 500 also includes a front slot 508 which is sized to fit around a portion of fingerboard 340 and neck 310 when top shell body 500 is placed over main body 130 and secured to bottom shell body 510. Bottom shell body 510 includes an electrical connector 100 and a graphic storage area 120 similar to such components as illustrated in FIGS. 1–3. Bottom shell body 510 also includes several connector openings 512 which are used to secure bottom shell body 510 to top shell body 500. As can be appreciated, screws, bolts, and/or other connectors can be used to secure the top shell body and bottom shell body together. Bottom shell body 510 also includes a central cavity 516 and a front lip 514 which function similarly to central cavity 36 and front lip 38 of shell body 30 as illustrated in FIGS. 1–3. Bottom shell body 510 also includes a jack groove 518 which is designed to receive a portion of jack 50 which is secured to top shell body 500.

Top shell body 500 and bottom shell body 510 are designed to clamp main body 130 between the two shell bodies. In this configuration, the face of the modular guitar can more closely emulate standard electric guitars. The modular guitar disclosed in FIGS. 1–3 slightly displays the profile of the main body when it is inserted into shell body 30. The use of the top shell body 500 and bottom shell body 510 as illustrated in FIG. 14 does not display the profile of the main body since the main body is sandwiched between the two shell bodies. As can be appreciated, the design and configuration of the top shell body and bottom shell body can be made to have various designs, which designs can be similar to those disclosed in FIGS. 12A–12K.

Figure 15:
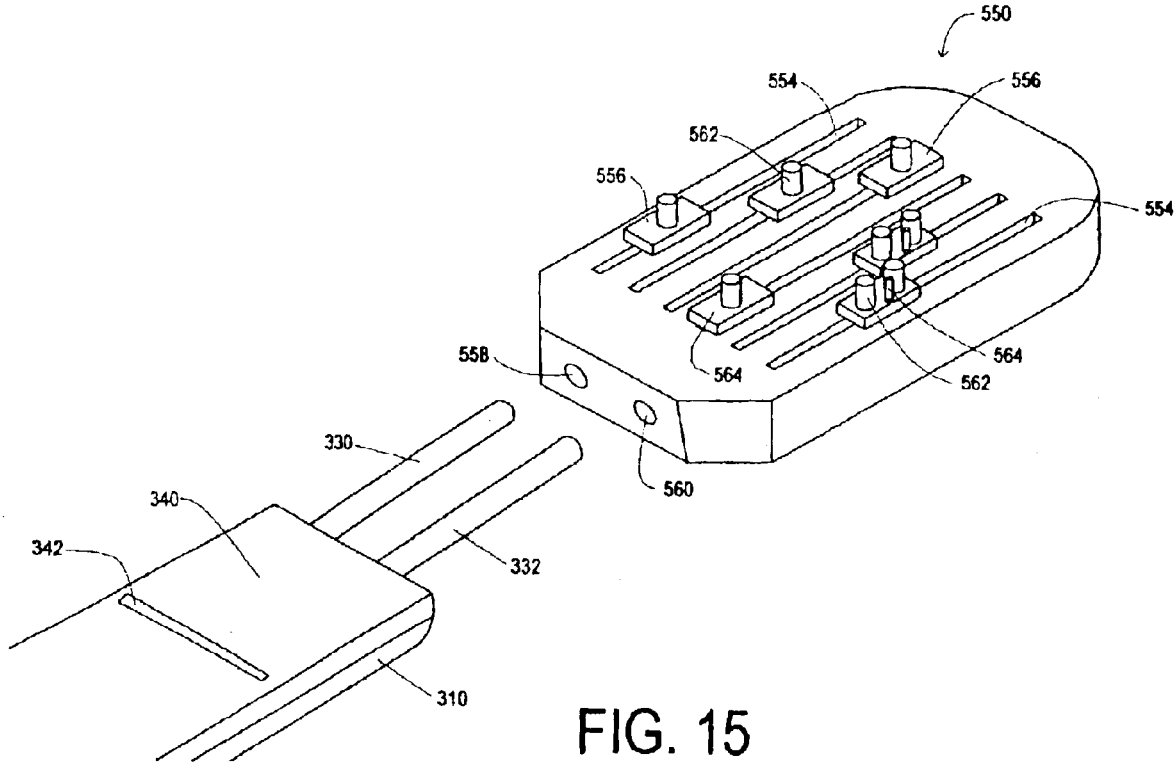
FIG. 15 is an elevation view of an alternative design for a headstock.

Referring now to FIG. 15, a modified headstock is illustrated. Headstock 550 includes two truss openings 558,560 that are designed to receive the end portions of truss rods 330, 332 on neck 310. The attachment and detachment of headstock 550 from neck 310 is similar to that of headstock 360 which is illustrated in FIGS. 1–3. Headstock 550 includes several pin slots 554 on the top surface 552 of the headstock. The pin slots are designed to receive slidable tuners 556. Each slidable tuner 556 includes one or more pins 562 connected to a pin base 564. The pin is designed to be connected to one end of a string. The string connected to the pin is tuned by sliding the slidable tuner along a pin slot 554 until the string is tuned. Thereafter, the slidable tuner is secured in position by a screw, bolt, etc. positioned on the back side of the headstock. As can be appreciated, many other arrangements can be used to secure and release the slidable tuner on the headstock. The used of this headstock arrangement has the advantage of reducing the incidence of one or more strings becoming inadvertently untuned when the headstock comes in contact with another surface. Classic headstocks include tuners having a configuration similar to tuners 390 that are illustrated in FIGS. 1–3. These standard tuners include pegs 394 that are used to tune the strings. When the headstock encounters a surface, one or more pegs on the headstock may engage such surface and cause the peg to move, thereby altering the tuning of a string. The headstock illustrated in FIG. 15 has no pegs, thus is less susceptible to one or more strings becoming out of tune when the headstock encounter a surface.

Figures 16, 17:
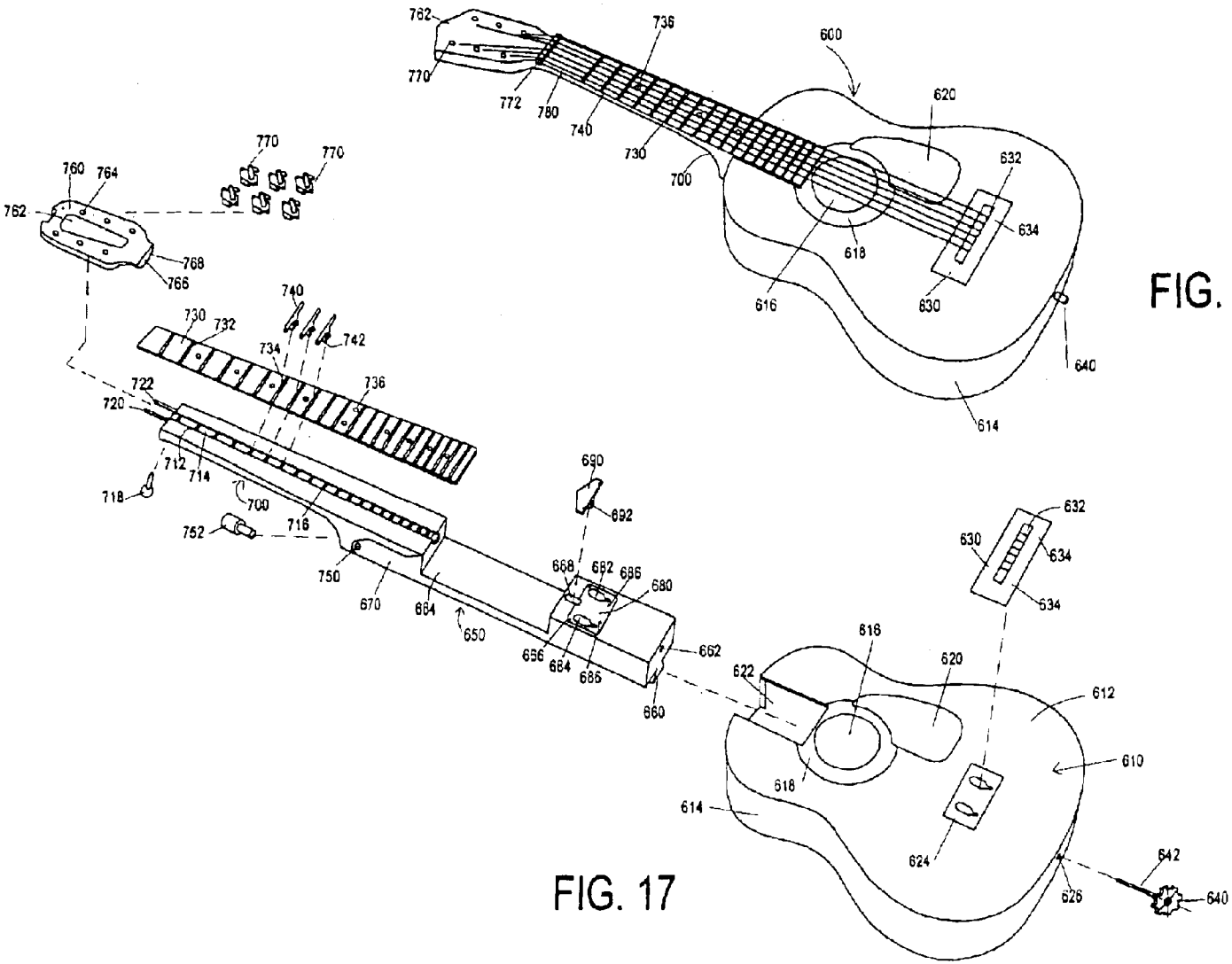
FIG. 16 is another embodiment of the interchangeable acoustic guitar in accordance with the invention; and, FIG. 17 is a partial exploded of the interchangeable acoustic guitar of FIG. 16.

Referring now to FIGS. 16 and 17, there is illustrated a modular acoustic guitar such as a standard acoustic guitar or a classic guitar. As can be appreciated, other modular arrangements can be applied to various other types of acoustic instruments such as, but not limited to, a balalaika, a banjo, a cello, a double bass, flamenco guitar, a lyre, a mandolin, a twelve-string acoustic guitar, a viola, a violin, etc. As illustrated in FIG. 16, a fully assembled acoustic guitar 600 is disclosed. The acoustic guitar includes a shell body 610 which has a top surface 612 and a side surface or rib 614. The top surface includes a sound hole 616 and a rose 618 which encircles the sound hole. A pick guard 620 is positioned closely adjacent to the sound hole. As best illustrated in FIG. 17, the shell body also includes a neck slot 622 positioned at the front end of the shell body and a bridge cavity 624 positioned rearwardly of the sound hole. Positioned in the back end of the shell body is an end opening 626. The shell body of the acoustic guitar is typically made of wood such as, but not limited to, red fir, cedar, redwood, laminated woods, and the like. The materials that make the top surface, the back surface, and/or more one or more side surfaces of the acoustic guitar may be made of the same material or different materials. The top surface of the acoustic guitar can have many types of designs, finishes, and/or the like. The interior of the shell body typically includes one or more reinforcing strips (i.e. radials) to provide structural strength to the shell body. The basic construction and structure of the shell body is well known in the art, and thus will not be further described.

Acoustic guitar 600 also includes a main body 650 which is designed to be inserted into and secured to shell body 610. Main body 650 includes a mount groove 660 at the base of the main body which is designed to be received by a groove in the interior of shell body 610. The mount grooves on main body 650 and in shell body 610 are designed to properly guide main body 650 in the interior of shell body 610 and to at least partially secure main body 650 in place relative to the shell body. At the end of main body 650 is an end opening 662 which is designed to receive a threaded end 642 of bridge clamping knob 640. Main body 650 also includes a central cavity 664 and a bridge cavity 666 which has a clamping slot 668. Positioned on the front of the main body is a front lip 670 to which neck 700 is connected to main body 650.

A bridge mounting plate 680 is at least partially mounted over bridge cavity 666. Bridge mounting plate 680 includes two plate slots 682, 684 which include a wide portion and a narrow portion. Mounting pins 686 are used to secure bridge mounting plate 680 to main body 650. A bridge clamping lock 690 having a threaded opening 692 is positioned in clamping slot 668. Threaded opening 692 is designed to receive threaded end 642 of bridge clamping knob 640.

Neck 700 is hingably connected to the end of main body 650 by a hinge 750. A hinge lock 752 is used to lock the neck in an extended and/or folded position. Hinge lock 752 typically includes a threaded end which is threaded into an opening in a bottom surface of the neck and into an opening in the back end of main body 650.

Neck 700 includes a fret cavity 712 designed to receive a cylindrically shaped fret bar 714. Fret bar 714 includes several bar slots which are adapted to receive fret nodes 742 of frets 740. A fret control knob 718 is used to rotate fret control bar 714 to cause the frets to be raised and/or lowered with respect to the upper surface of fingerboard 730, which is positioned on the top surface of neck 700. Two truss rods 720, 722 are positioned in neck 700 to provide structural support and rigidity to neck 700. The two truss rods have a length such that the ends of the two truss rods extend outwardly from the end of neck 700 after being fully placed within the neck.

Fingerboard 730 includes several fret slots 732 having fret openings 734. The fret openings 734 are designed to receive a bottom portion of fret 740. Fingerboard 730 also includes several position or fret markers 736.

Releasably connected to the end of neck 700 is a headstock 760. Headstock 760 includes two truss openings 766 and 768 which are designed to receive a portion of the ends of truss rods 720 and 722. Headstock 760 can include a graphic slot 762 which is designed to receive. one or more. graphics; however, the use of a graphic slot on a headstock is not required. The headstock also includes several tuner openings 764 which are designed to receive the pins of tuners 770. The front end of the headstock also includes a nut 768 which is used to guide strings 780 as illustrated in FIG. 16.

The operation of the acoustic guitar as illustrated in FIGS. 16 and 17 will now be briefly described. Main body 750 is connected to shell body 610 by inserting the front end of main body 650 through an opening in the front end of shell body 610. Mount groove 660 on main body 650 is oriented to engage a corresponding slot in the interior of shell body 610 so as to guide the main body 650 into the interior of shell body 610. Once main body 650 is properly positioned in shell body 610, neck 700 is positioned into the extended position and locked in the extended position if it is not already in such position. Typically, neck 700 is positioned and locked into an extended position prior to the main body being inserted into the shell body 610. Headstock 760 having a headstock nut 772, is connected to the end of neck 700 by inserting the ends of truss rod 720, 722 into truss openings 766, 768 of headstock 760. Once the headstock is positioned on the end of neck 700, bridge plate 630 is positioned on bridge mounting plate 680. The strings connected between bridge pins 634 on bridge plate 630 and the pins on headstock 760 are moved into a tensioned position by rotating bridge clamping knob 640. The rotation of bridge clamping knob 640 causes bridge clamping lock 690 to move rearwardly toward the end of shell body 610. This rearward movement also causes bridge plate 630 to move rearwardly, thereby producing tension on strings 780. The bottom of bridge plate 630 includes two locking pins having heads that are positioned in the wide portion of slots 682, 684 of bridge mounting plate 680. As bridge plate 630 moves rearwardly, the heads of the pins move into the narrow portion of slots 682, 684, thereby locking bridge plate 630 to bridge mounting plate 680. The turning of bridge clamping knob 640 also results in the clamping knob being threaded at least partially into end opening 662 of main body 650 thereby securing main body 650 to shell body 610. The final tuning of the strings 780 is accomplished by the use of tuners 770 on headstock 660.

When the acoustic guitar needs to be packed, the main body can be easily disengaged from the shell body by merely rotating bridge clamping knob 640 such that bridge clamping lock 690 moves rearwardly to thereby release bridge plate 630 from bridge mounting plate 680. The turning of bridge clamping knob 640 also releases the end of main body 650 from shell body 610; thus, once bridge plate 630 is disengaged from bridge mounting plate 680, the headstock can then be removed from the end of neck 700 such that the headstock, strings, and bridge plate can be stored away. Once the bridge plate is removed from the bridge mounting plate, the main body 650 can be slidably removed from shell body 610. The neck hidgedly connect to the main body can be moved into a collapsed positioned by removing hinge lock 652 to allow the neck to be moved into a collapsed position, thereby reducing the storage area needed for the main body and the neck. As can be appreciated, the neck can be detachably connected to the main body. In certain applications, the strings of the acoustic guitar are only desired to be changed such as changing the strings from metal strings to nylon strings. During such a change, main body 650 can be left within shell body 610 and merely the headstock, strings, and mounting plate are removed from the acoustic guitar and a new set of headstock, strings, and mounting plate are secured to the acoustic guitar. In some applications, different necks of the acoustic guitar are required; thus, in such a situation, the neck and main body of the guitar needs to be removed as discussed above.

As stated above, the embodiments disclosed in FIGS. 1–3, 14, 16 and 17 allow for multiple modular guitar configurations, thereby significantly expanding the use of the guitar. As can be appreciated, the neck of the guitar can be detachably connected to the main body to substitute one neck for another. For example, the neck of an electric guitar can be substituted so as to change the length of the neck for purposes of changing the electric guitar from a classic electric guitar to a bass guitar.

The present invention has been described with reference to a number of different embodiments. It is to be understood that the invention is not limited to the exact details of construction, operation, exact materials or embodiments shown and described, as obvious modifications and equivalents will be apparent to one skilled in the art. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

I claim:

1. A stringed instrument having a shell body, a main body and a neck, a headstock and a plurality of strings, said main body detachably connected to the shell body, said main body connected to a bridge, said neck connected to said shell body, said main body, or combinations thereof, said plurality of strings connected to said headstock and said main body, said headstock removably connected to said neck, said headstock including sliding pins that are connectable to at least one string.

2. The stringed instrument as defined in claim 1, wherein said shell body and main body are components of a guitar.

3. The stringed instrument as defined in claim 1, wherein said main body includes at least one electronic component, said at least one electric component including a pickup box.

4. The stringed instrument as defined in claim 1, wherein said neck is connected to said shell body.

5. The stringed instrument as defined in claim 4, wherein said neck is hingably connected to said shell body.

6. The stringed instrument as defined in claim 4, wherein said neck is detachably connected to said shell body.

7. The stringed instrument as defined in claim 1, wherein said neck is connected to said main body.

8. The stringed instrument as defined in claim 7, wherein said neck is hingably connected to said main body.

9. The stringed instrument as defined in claim 7, wherein said neck is detachably connected to said main body.

10. The stringed instrument as defined in claim 1, wherein said neck includes a fret control to at least partially raise and lower at least one fret on said neck.

11. The stringed instrument as defined in claim 1, including a connector that detachably connects said shell body to said main body.

12. The stringed instrument as defined in claim 11, wherein said connector includes a mechanism selected from the group consisting of VELCRO, a latch, a clamp, a lock, a slider, a tension wheel, and combinations thereof.

13. The stringed instrument as defined in claim 1, including a headstock protector that at least partially shields pins, pegs or combinations thereof on said headstock.

14. The stringed instrument as defined in claim 1, wherein said main body includes a mounting box for at least one electronic pickup, said mounting box releasably connected to said main body.

15. The stringed instrument as defined in claim 1, wherein said main body includes a string tensioner connected to said bridge to increase and reduce tension on a plurality of strings connected to said bridge to tune said strings.

16. A stringed instrument having a shell body, a main body, neck, and a humidity tuner, said main body detachably connected to the shell body, said main body connected to a bridge, said neck connected to said shell body, said main body, or combinations thereof, said humidity tuner at least partially positioned on said neck.

17. The stringed instrument as defined in claim 16, wherein said humidity tuner is at least partially positioned between said headstock and said neck.

18. A stringed instrument having a shell body, a main body and a neck, said main body, said neck, or combinations thereof connected to said shell body, said main body detachably connected to said shell body, said main body connected to a bridge, said neck is connected to a headstock, at least a portion of said bridge is detachably connected to said main body by a connection mechanism that includes a mechanism selected from the group consisting of a latch, a clamp, a lock, a slider, a tension wheel or combinations thereof, said headstock detachably connected to said neck, said headstock including sliding pins that are connectable to at least one string.

19. The stringed instrument as defined in claim 18, wherein said neck is hingably connected to said shell body.

20. The stringed instrument as defined in claim 18, wherein said neck is detachably connected to said shell body.

21. The stringed instrument as defined in claim 18, wherein said shell body and main body are components of a guitar.

22. The stringed instrument as defined in claim 18, wherein said main body includes at least one electronic component, said at least one electric component including a pickup box.

23. The stringed instrument as defined in claim 18, wherein said neck includes a fret control to at least partially raise and lower at least one fret on said neck.

24. The stringed instrument as defined in claim 18, including a connector that detachably connects said shell body to said main body.

25. The stringed instrument as defined in claim 24, wherein said connector includes a mechanism selected from the group consisting of VELCRO, a latch, a clamp, a lock, a slider, a tension wheel, and combinations thereof.

26. The stringed instrument as defined in claim 18, including a headstock protector, that at least partially shields pins, pegs or combinations thereof on said headstock.

27. The stringed instrument as defined in claim 18, wherein said main body includes a mounting box for at least one electronic pickup, said mounting box releasably connected to said main body.

28. The stringed instrument as defined in claim 18, wherein said main body includes a string tensioner connected to said bridge to increase and reduce tension on a plurality of strings connected to said bridge to tune said strings.

29. A stringed instrument having a shell body, a main body and a neck, said main body and neck connected to said shell body, said main body detachably connected to said shell body, said main body connected tea bridge, said neck connected to a headstock, at least a portion of said bridge detachably, connected to said main body, said headstock detachably connected to said neck, said neck including a humidity tuner.

30. The stringed instrument as defined in claim 29, wherein said humidity tuner is at least partially positioned between said headstock and said neck.

31. A stringed instrument having a shell body, a main body, a neck, a string tensioner, and a humidity tuner, said main body connected to a bridge, said neck connected to said shell body, said main body, or combinations thereof, said neck connected to a headstock, at least one string connected between said headstock and said bridge, said humidity tuner connected between said neck and said headstock to adjust the tension of said at least one string to compensate for humidity and/or temperature changes, said string tensioner connected to said bridge to increase and reduce tension on at least one of said strings connected between said bridge and said headstock.

32. The stringed instrument as defined in claim 31, wherein said shell body, said main body, and said neck are components of a guitar.

33. The stringed instrument as defined in claim 31, wherein said main body includes at least one electronic component.

34. The stringed instrument as defined in claim 31, wherein said neck is connected to said shell body.

35. The stringed instrument as defined in claim 34, wherein said neck is detachably connected to said shell body.

36. The stringed instrument as defined in claim 34, wherein said neck is hingably connected to said shell body.

37. The stringed instrument as defined in claim 31, wherein said neck is connected to said main body.

38. The stringed instrument as defined in claim 37, wherein said neck is hingably connected to said main body.

39. The stringed instrument as defined in claim 37, wherein said neck is detachably connected to said main body.

40. The headstock as defined in claim 38, wherein said connector includes at least one opening.

41. The stringed instrument as defined in claim 31, wherein said bridge is detachably connected to said main body.

42. The stringed instrument as defined in claim 31, wherein said humidity tuner is at least partially located between said headstock and said neck.

43. The stringed instrument as defined in claim 31, wherein said humidity tuner includes a tuning wheel used to adjust the tension on at least one of said strings.

44. The stringed instrument as defined in claim 31, wherein headstock includes at least one guide arrangement to at least partially guide the movement of said headstock relative to said neck during the use of said humidity tuner.

45. The stringed instrument as defined in claim 31, wherein said neck includes a fret control to at least partially raise and lower at least one fret on said neck.

46. The stringed instrument as defined in claim 31, wherein said string tensioner includes a tension wheel used to adjust the tension on at least one of said strings connected to said bridge.

47. The stringed instrument as defined in claim 31, including a headstock protector.

48. The stringed instrument as defined in claim 31, wherein said main body includes a mounting box for at least one pickup, said mounting box releasably connected to said main body.

49. A headstock adapted for use on a stringed instrument, said headstock including at least one sliding pin adapted to be connected to at least one string.

50. The headstock as defined in claim 49, including a releasably secure mechanism to secure said sliding pin in at least one position.

51. The headstock as defined in claim 49, including at least one connector adapted to releasably connect said headstock to a neck of a stringed instrument.

52. A neck adapted for use with a stringed instrument, said neck including at least one fret opening in an upper face of said neck, a fret positioned in the fret opening, and a fret control that at least partially raises and/or lowers the fret in the fret opening.

53. The neck as defined in claim 52, wherein said neck includes at least one support structure that extends at least partially the longitudinal length of said neck to provide structural support to said neck.

54. The neck as defined in claim 52, wherein said fret control includes a fret control bar, said fret control bar at least partially moveable relative to said neck to at least partially cause said fret to move.

55. The neck as defined in claim 52, wherein said fret control includes a fret control handle adapted to facilitate in the movement of said fret control bar.

56. A headstock protector that is releasably connected to a headstock of a stringed instrument, said headstock protector including a body that at least partially covers and at least partially shields pins, pegs or combinations thereof on said headstock, said body including a top component and a bottom component, said top and bottom components designed to at least partially encapsulate said headstock when said top and bottom components are connected to said headstock, said top and bottom components are hingably connected together.

57. The head stock protector as defined in claim 56, wherein said top and bottom components include a plurality of slots that are designed to receive said pins, said pegs or combinations thereof when said top and bottom components are connected to said headstock.

* * * * *